US008956184B2

(12) United States Patent
Chawgo et al.

(10) Patent No.: US 8,956,184 B2
(45) Date of Patent: Feb. 17, 2015

(54) COAXIAL CABLE CONNECTOR

(71) Applicant: John Mezzalingua Associates, LLC, Liverpool, NY (US)

(72) Inventors: Shawn M. Chawgo, Cicero, NY (US); Noah P. Montena, Syracuse, NY (US)

(73) Assignee: John Mezzalingua Associates, LLC, Liverpool, NY (US)

( * ) Notice: Subject to any disclaimer, the term of this patent is extended or adjusted under 35 U.S.C. 154(b) by 0 days.

(21) Appl. No.: 14/200,605

(22) Filed: Mar. 7, 2014

(65) Prior Publication Data

US 2014/0213106 A1 Jul. 31, 2014

Related U.S. Application Data

(63) Continuation of application No. 13/784,499, filed on Mar. 4, 2013, now Pat. No. 8,708,737, which is a continuation of application No. 13/093,937, filed on Apr. 26, 2011, now Pat. No. 8,388,375, and a continuation of application No. 12/753,735, filed on Apr. 2, 2010, now Pat. No. 7,934,954.

(51) Int. Cl.

| | |
|---|---|
| ***H01R 9/05*** | (2006.01) |
| ***H01R 24/38*** | (2011.01) |
| ***H01R 24/56*** | (2011.01) |
| *H01R 103/00* | (2006.01) |

(52) U.S. Cl.

CPC ..... *H01R 24/38* (2013.01); *H01R 9/0524* (2013.01); *H01R 24/56* (2013.01); *H01R 2103/00* (2013.01)

USPC ..... 439/578; 430/583; 430/584; 430/585

(58) Field of Classification Search

CPC ..... H01R 9/0524; H01R 24/56; H01R 24/38

USPC ..... 439/578, 583, 584, 585

See application file for complete search history.

(56) References Cited

U.S. PATENT DOCUMENTS

| | | | |
|---|---|---|---|
| 2,258,737 | A | 10/1941 | Browne |
| 2,785,384 | A | 3/1957 | Wickesser |
| 3,022,482 | A | 2/1962 | Waterfield et al. |
| 3,076,169 | A | 1/1963 | Blaisdell |
| 3,184,706 | A | 5/1965 | Atkins |
| 3,221,290 | A | 11/1965 | Stark et al. |
| 3,275,913 | A | 9/1966 | Blanchard et al. |

(Continued)

FOREIGN PATENT DOCUMENTS

| | | |
|---|---|---|
| CN | 1985408 A | 6/2007 |
| DE | 29800824 | 4/1998 |

(Continued)

OTHER PUBLICATIONS

Chinese Office Action dated Nov. 27, 2013, for corresponding Chinese Application 201010225736.0, filed on May 20, 2010. 18 pages.

(Continued)

*Primary Examiner* — Tho D Ta

(74) *Attorney, Agent, or Firm* — Hiscock & Barclay, LLP

(57) ABSTRACT

A coaxial cable connector includes, in one embodiment, a coupler, a body, an inner conductor engager and an outer conductor engager. The connector also includes a driver configured to axially move along an axis as a result of at least one axial installation force.

64 Claims, 21 Drawing Sheets

(56) References Cited

U.S. PATENT DOCUMENTS

| | | | |
|---|---|---|---|
| 3,297,979 | A | 1/1967 | O'Keefe et al. |
| 3,321,732 | A | 5/1967 | Forney, Jr. |
| 3,355,698 | A | 11/1967 | Keller |
| 3,372,364 | A | 3/1968 | O'Keefe et al. |
| 3,406,373 | A | 10/1968 | Forney, Jr. |
| 3,498,647 | A | 3/1970 | Schroeder |
| 3,539,976 | A | 11/1970 | Reynolds |
| 3,581,269 | A | 5/1971 | Frey |
| 3,629,792 | A | 12/1971 | Dorrell |
| 3,671,922 | A | 6/1972 | Zerlin et al. |
| 3,671,926 | A | 6/1972 | Nepovim |
| 3,678,446 | A | 7/1972 | Siebelist |
| 3,686,623 | A | 8/1972 | Nijman |
| 3,710,005 | A | 1/1973 | French |
| 3,744,011 | A | 7/1973 | Blanchenot |
| 3,757,279 | A | 9/1973 | Winston |
| 3,764,959 | A | 10/1973 | Toma et al. |
| 3,845,453 | A | 10/1974 | Hemmer |
| 3,879,102 | A | 4/1975 | Horak |
| 3,915,539 | A | 10/1975 | Collins |
| 3,936,132 | A | 2/1976 | Hutter |
| 3,963,321 | A | 6/1976 | Burger et al. |
| 3,985,418 | A | 10/1976 | Spinner |
| 4,035,054 | A | 7/1977 | Lattanzi |
| 4,046,451 | A | 9/1977 | Juds et al. |
| 4,047,291 | A | 9/1977 | Spinner |
| 4,053,200 | A | 10/1977 | Pugner |
| 4,059,330 | A | 11/1977 | Shirley |
| 4,126,372 | A | 11/1978 | Hashimoto et al. |
| 4,156,554 | A | 5/1979 | Aujla |
| 4,168,921 | A | 9/1979 | Blanchard |
| 4,173,385 | A | 11/1979 | Fenn et al. |
| 4,227,765 | A | 10/1980 | Neumann et al. |
| 4,280,749 | A | 7/1981 | Hemmer |
| 4,305,638 | A | 12/1981 | Hutter |
| 4,339,166 | A | 7/1982 | Dayton |
| 4,346,958 | A | 8/1982 | Blanchard |
| 4,354,721 | A | 10/1982 | Luzzi |
| 4,373,767 | A | 2/1983 | Cairns |
| 4,400,050 | A | 8/1983 | Hayward |
| 4,408,821 | A | 10/1983 | Forney, Jr. |
| 4,408,822 | A | 10/1983 | Nikitas |
| 4,421,377 | A | 12/1983 | Spinner |
| 4,444,453 | A | 4/1984 | Kirby et al. |
| 4,456,324 | A | 6/1984 | Staeger |
| 4,484,792 | A | 11/1984 | Tengler et al. |
| 4,491,685 | A | 1/1985 | Drew et al. |
| 4,533,191 | A | 8/1985 | Blackwood |
| 4,545,637 | A | 10/1985 | Bosshard et al. |
| 4,557,546 | A | 12/1985 | Dreyer |
| 4,575,274 | A | 3/1986 | Hayward |
| 4,583,811 | A | 4/1986 | McMills |
| 4,596,435 | A | 6/1986 | Bickford |
| 4,600,263 | A | 7/1986 | DeChamp et al. |
| 4,614,390 | A | 9/1986 | Baker |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,684,201 | A | 8/1987 | Hutter |
| 4,691,976 | A | 9/1987 | Cowen |
| 4,738,009 | A | 4/1988 | Down et al. |
| 4,746,305 | A | 5/1988 | Nomura |
| 4,747,786 | A | 5/1988 | Hayashi et al. |
| 4,755,152 | A | 7/1988 | Elliot et al. |
| 4,789,355 | A | 12/1988 | Lee |
| 4,804,338 | A | 2/1989 | Dibble et al. |
| 4,806,116 | A | 2/1989 | Ackerman |
| 4,813,886 | A | 3/1989 | Roos et al. |
| 4,824,400 | A | 4/1989 | Spinner |
| 4,824,401 | A | 4/1989 | Spinner |
| 4,834,675 | A | 5/1989 | Samchisen |
| 4,854,893 | A | 8/1989 | Morris |
| 4,857,014 | A | 8/1989 | Alf et al. |
| 4,869,679 | A | 9/1989 | Szegda |
| 4,892,275 | A | 1/1990 | Szegda |
| 4,902,246 | A | 2/1990 | Samchisen |
| 4,906,207 | A | 3/1990 | Banning et al. |
| 4,917,631 | A | 4/1990 | Souders et al. |
| 4,923,412 | A | 5/1990 | Morris |
| 4,925,403 | A | 5/1990 | Zorzy |
| 4,929,188 | A | 5/1990 | Lionetto et al. |
| 4,952,174 | A | 8/1990 | Sucht et al. |
| 4,973,265 | A | 11/1990 | Heeren |
| 4,990,104 | A | 2/1991 | Schieferly |
| 4,990,105 | A | 2/1991 | Karlovich |
| 4,990,106 | A | 2/1991 | Szegda |
| 5,002,503 | A | 3/1991 | Campbell et al. |
| 5,011,432 | A | 4/1991 | Sucht et al. |
| 5,021,010 | A | 6/1991 | Wright |
| 5,024,606 | A | 6/1991 | Ming-Hwa |
| 5,037,328 | A | 8/1991 | Karlovich |
| 5,062,804 | A | 11/1991 | Jamet et al. |
| 5,066,248 | A | 11/1991 | Gaver, Jr. et al. |
| 5,073,129 | A | 12/1991 | Szegda |
| 5,083,943 | A | 1/1992 | Tarrant |
| 5,127,853 | A | 7/1992 | McMills et al. |
| 5,131,862 | A | 7/1992 | Gershfeld |
| 5,137,471 | A | 8/1992 | Verespej et al. |
| 5,141,451 | A | 8/1992 | Down |
| 5,154,636 | A | 10/1992 | Vaccaro et al. |
| 5,166,477 | A | 11/1992 | Perin, Jr. et al. |
| 5,181,161 | A | 1/1993 | Hirose et al. |
| 5,195,906 | A | 3/1993 | Szegda |
| 5,205,761 | A | 4/1993 | Nilsson |
| 5,207,602 | A | 5/1993 | McMills et al. |
| 5,217,391 | A | 6/1993 | Fisher, Jr. |
| 5,217,393 | A | 6/1993 | Del Negro et al. |
| 5,269,701 | A | 12/1993 | Leibfried, Jr. |
| 5,283,853 | A | 2/1994 | Szegda |
| 5,284,449 | A | 2/1994 | Vaccaro |
| 5,295,864 | A | 3/1994 | Birch et al. |
| 5,315,684 | A | 5/1994 | Szegda |
| 5,316,494 | A | 5/1994 | Flanagan et al. |
| 5,322,454 | A | 6/1994 | Thommen |
| 5,338,225 | A | 8/1994 | Jacobsen et al. |
| 5,340,332 | A | 8/1994 | Nakajima et al. |
| 5,342,218 | A | 8/1994 | McMills et al. |
| 5,352,134 | A | 10/1994 | Jacobsen et al. |
| 5,354,217 | A | 10/1994 | Gabel et al. |
| 5,371,819 | A | 12/1994 | Szegda |
| 5,371,821 | A | 12/1994 | Szegda |
| 5,371,827 | A | 12/1994 | Szegda |
| 5,393,244 | A | 2/1995 | Szegda |
| 5,431,583 | A | 7/1995 | Szegda |
| 5,435,745 | A | 7/1995 | Booth |
| 5,444,810 | A | 8/1995 | Szegda |
| 5,455,548 | A | 10/1995 | Grandchamp et al. |
| 5,456,611 | A | 10/1995 | Henry et al. |
| 5,456,614 | A | 10/1995 | Szegda |
| 5,466,173 | A | 11/1995 | Down |
| 5,470,257 | A | 11/1995 | Szegda |
| 5,494,454 | A | 2/1996 | Johnsen |
| 5,501,616 | A | 3/1996 | Holliday |
| 5,518,420 | A | 5/1996 | Pitschi |
| 5,525,076 | A | 6/1996 | Down |
| 5,542,861 | A | 8/1996 | Anhalt et al. |
| 5,548,088 | A | 8/1996 | Gray et al. |
| 5,561,900 | A | 10/1996 | Hosler, Sr. |
| 5,571,028 | A | 11/1996 | Szegda |
| 5,586,910 | A | 12/1996 | Del Negro et al. |
| 5,598,132 | A | 1/1997 | Stabile |
| 5,607,325 | A | 3/1997 | Toma |
| 5,619,015 | A | 4/1997 | Kirma |
| 5,651,698 | A | 7/1997 | Locati et al. |
| 5,651,699 | A | 7/1997 | Holliday |
| 5,662,489 | A | 9/1997 | Stirling |
| 5,667,405 | A | 9/1997 | Holliday |
| 5,785,554 | A | 7/1998 | Oshiro |
| 5,795,188 | A | 8/1998 | Harwath |
| 5,863,220 | A | 1/1999 | Holliday |

(56) References Cited

U.S. PATENT DOCUMENTS

| | | | |
|---|---|---|---|
| 5,938,474 | A | 8/1999 | Nelson |
| 5,957,724 | A | 9/1999 | Lester |
| 5,975,951 | A | 11/1999 | Burris et al. |
| 5,984,723 | A | 11/1999 | Wild |
| 5,993,254 | A | 11/1999 | Pitschi et al. |
| 5,997,350 | A | 12/1999 | Burris et al. |
| 6,019,636 | A | 2/2000 | Langham |
| 6,027,373 | A | 2/2000 | Gray et al. |
| 6,032,358 | A | 3/2000 | Wild |
| 6,034,325 | A | 3/2000 | Nattel et al. |
| 6,036,237 | A | 3/2000 | Sweeney |
| RE36,700 | E | 5/2000 | McCarthy |
| 6,080,015 | A | 6/2000 | Andreescu |
| 6,089,912 | A | 7/2000 | Tallis et al. |
| 6,089,913 | A | 7/2000 | Holliday |
| 6,109,964 | A | 8/2000 | Kooiman |
| 6,146,197 | A | 11/2000 | Holliday et al. |
| 6,153,830 | A | 11/2000 | Montena |
| 6,159,046 | A | 12/2000 | Wong |
| 6,168,455 | B1 | 1/2001 | Hussaini |
| 6,217,380 | B1 | 4/2001 | Nelson et al. |
| 6,293,004 | B1 | 9/2001 | Holliday |
| 6,396,367 | B1 | 5/2002 | Rosenberger |
| 6,409,536 | B1 | 6/2002 | Kanda et al. |
| 6,471,545 | B1 | 10/2002 | Hosler, Sr. |
| 6,536,103 | B1 | 3/2003 | Holland et al. |
| 6,551,136 | B2 | 4/2003 | Johnsen et al. |
| 6,558,194 | B2 | 5/2003 | Montena |
| 6,607,398 | B2 | 8/2003 | Henningsen |
| 6,634,906 | B1 | 10/2003 | Yeh |
| 6,648,683 | B2 | 11/2003 | Youtsey |
| 6,667,440 | B2 | 12/2003 | Nelson et al. |
| 6,676,446 | B2 | 1/2004 | Montena |
| 6,733,336 | B1 | 5/2004 | Montena et al. |
| 6,780,052 | B2 | 8/2004 | Montena et al. |
| 6,808,415 | B1 | 10/2004 | Montena |
| 6,808,417 | B2 | 10/2004 | Yoshida |
| 6,840,803 | B2 | 1/2005 | Wlos et al. |
| 6,848,940 | B2 | 2/2005 | Montena |
| 6,884,113 | B1 | 4/2005 | Montena |
| 6,887,103 | B2 | 5/2005 | Montena et al. |
| 6,994,588 | B2 | 2/2006 | Montena |
| 7,011,546 | B2 | 3/2006 | Vaccaro |
| 7,029,304 | B2 | 4/2006 | Montena |
| 7,029,326 | B2 | 4/2006 | Montena |
| 7,044,785 | B2 | 5/2006 | Harwath et al. |
| 7,048,579 | B2 | 5/2006 | Montena |
| 7,070,447 | B1 | 7/2006 | Montena |
| 7,104,839 | B2 | 9/2006 | Henningsen |
| 7,108,547 | B2 | 9/2006 | Kisling et al. |
| 7,127,806 | B2 | 10/2006 | Nelson et al. |
| 7,128,603 | B2 | 10/2006 | Burris et al. |
| 7,131,868 | B2 | 11/2006 | Montena |
| 7,140,914 | B2 | 11/2006 | Kojima |
| 7,156,696 | B1 | 1/2007 | Montena |
| 7,160,149 | B1 | 1/2007 | Chawgo |
| 7,163,420 | B2 | 1/2007 | Montena |
| 7,189,114 | B1 | 3/2007 | Burris et al. |
| 7,189,115 | B1 | 3/2007 | Montena |
| 7,207,838 | B2 | 4/2007 | Andreescu |
| 7,217,154 | B2 | 5/2007 | Harwath |
| 7,217,155 | B2 | 5/2007 | Montena |
| 7,261,581 | B2 | 8/2007 | Henningsen |
| 7,275,957 | B1 | 10/2007 | Wlos |
| 7,278,887 | B1 | 10/2007 | Palinkas et al. |
| 7,311,554 | B1 | 12/2007 | Jacksen et al. |
| 7,335,059 | B2 | 2/2008 | Vaccaro |
| 7,351,101 | B1 | 4/2008 | Montena |
| 7,357,671 | B2 | 4/2008 | Wild et al. |
| 7,357,672 | B2 | 4/2008 | Montena |
| 7,374,455 | B2 | 5/2008 | Purdy et al. |
| 7,381,089 | B2 | 6/2008 | Hosler |
| 7,384,307 | B1 | 6/2008 | Wang |
| 7,393,245 | B2 | 7/2008 | Palinkas et al. |
| 7,431,614 | B2 | 10/2008 | Eriksen |
| 7,435,135 | B2 | 10/2008 | Wlos |
| 7,458,851 | B2 | 12/2008 | Montena |
| 7,473,128 | B2 | 1/2009 | Montena |
| 7,488,209 | B2 | 2/2009 | Vaccaro |
| 7,500,874 | B2 | 3/2009 | Montena |
| 7,527,512 | B2 | 5/2009 | Montena |
| 7,588,460 | B2 | 9/2009 | Malloy et al. |
| 7,632,141 | B2 | 12/2009 | Malak |
| 7,637,774 | B1 | 12/2009 | Vaccaro |
| 7,749,022 | B2 | 7/2010 | Amidon et al. |
| 7,887,366 | B2 | 2/2011 | Chee et al. |
| 7,892,005 | B2 | 2/2011 | Haube |
| 7,908,741 | B2 | 3/2011 | Chawgo |
| 7,921,549 | B2 | 4/2011 | Chawgo et al. |
| 7,934,954 | B1 | 5/2011 | Chawgo et al. |
| 7,967,635 | B2 | 6/2011 | Amidon et al. |
| 7,972,175 | B2 | 7/2011 | Chawgo |
| 7,993,159 | B2 | 8/2011 | Chawgo |
| 8,007,314 | B2 | 8/2011 | Chawgo et al. |
| 2001/0051448 | A1 | 12/2001 | Gonzales |
| 2002/0030329 | A1 | 3/2002 | Montena |
| 2003/0025283 | A2 | 2/2003 | Montena |
| 2003/0068924 | A1 | 4/2003 | Montena |
| 2003/0114045 | A1 | 6/2003 | Montena |
| 2005/0148236 | A1 | 7/2005 | Montena |
| 2005/0159043 | A1 | 7/2005 | Harwath et al. |
| 2005/0159044 | A1 | 7/2005 | Harwath et al. |
| 2005/0164553 | A1 | 7/2005 | Montena |
| 2006/0014425 | A1 | 1/2006 | Montena |
| 2006/0014426 | A1 | 1/2006 | Montena |
| 2006/0073726 | A1 | 4/2006 | Montena |
| 2006/0105628 | A1 | 5/2006 | Montena |
| 2006/0172571 | A1 | 8/2006 | Montena |
| 2006/0194474 | A1 | 8/2006 | Montena |
| 2006/0292925 | A1 | 12/2006 | Chawgo |
| 2007/0123101 | A1 | 5/2007 | Palinkas |
| 2007/0190854 | A1 | 8/2007 | Harwath |
| 2007/0270032 | A1 | 11/2007 | Eriksen |
| 2007/0281542 | A1 | 12/2007 | Palinkas et al. |
| 2008/0020637 | A1 | 1/2008 | Montena |
| 2008/0081512 | A1 | 4/2008 | Chawgo |
| 2008/0096419 | A1 | 4/2008 | Purdy et al. |
| 2008/0113554 | A1 | 5/2008 | Montena |
| 2008/0207033 | A1 | 8/2008 | Malak |
| 2008/0207051 | A1 | 8/2008 | Montena |
| 2008/0274643 | A1* | 11/2008 | Chawgo ..... 439/583 |
| 2009/0019704 | A1 | 1/2009 | Ehret et al. |
| 2009/0064490 | A1 | 3/2009 | Chawgo et al. |
| 2009/0064754 | A1 | 3/2009 | Chawgo |
| 2009/0197465 | A1 | 8/2009 | Montena et al. |
| 2009/0233482 | A1 | 9/2009 | Chawgo et al. |
| 2009/0269979 | A1 | 10/2009 | Montena |
| 2010/0261381 | A1 | 10/2010 | Montena et al. |
| 2010/0261382 | A1 | 10/2010 | Montena et al. |
| 2010/0276176 | A1 | 11/2010 | Amato |
| 2010/0297871 | A1 | 11/2010 | Haube |
| 2011/0225814 | A1 | 9/2011 | Amato |
| 2011/0237126 | A1 | 9/2011 | Amidon et al. |
| 2011/0239451 | A1 | 10/2011 | Montena et al. |
| 2011/0239455 | A1 | 10/2011 | Montena et al. |

FOREIGN PATENT DOCUMENTS

| | | | |
|---|---|---|---|
| EP | 10567 | | 5/1980 |
| EP | 0518597 | A2 | 12/1992 |
| EP | 0518597 | A3 | 4/1993 |
| EP | 0555579 | A1 | 8/1993 |
| EP | 918370 | | 5/1999 |
| EP | 2063501 | A1 | 5/2009 |
| JP | 2002373743 | A1 | 12/2002 |
| WO | 2008011202 | A2 | 1/2008 |
| WO | 2008011241 | A2 | 1/2008 |
| WO | 2008021621 | A2 | 2/2008 |
| WO | 2008051709 | A2 | 5/2008 |
| WO | 2008011241 | A3 | 7/2008 |
| WO | 2008051709 | A3 | 8/2008 |
| WO | 2008103634 | A1 | 8/2008 |
| WO | 2008021621 | A3 | 10/2008 |
| WO | 2008137336 | A1 | 11/2008 |

(56) References Cited

FOREIGN PATENT DOCUMENTS

| | | | |
|---|---|---|---|
| WO | 2008011202 | A3 | 12/2008 |
| WO | 2009035879 | A2 | 3/2009 |
| WO | 2009035879 | A3 | 5/2009 |
| WO | 2010117890 | A2 | 10/2010 |
| WO | 2010126796 | A2 | 11/2010 |
| WO | 2010126862 | A2 | 11/2010 |
| WO | 2010135198 | A2 | 11/2010 |

OTHER PUBLICATIONS

Amidon, J., "Impedance Management in Coaxial Cable Terminations," U.S. Appl. No. 12/753,719, filed Apr. 2, 2010.

Chawgo, S., et al., Coaxial Cable Compression Connectors, U.S. Appl. No. 12/753,735, filed Apr. 2, 2010, Notice of Allowance, dated Dec. 23, 2010.

Chawgo, S., et al., Coaxial Cable Compression Connectors, U.S. Appl. No. 12/753,735, filed Apr. 2, 2010, Office Action Summary dated Sep. 8, 2010.

Montena. N. et al., Coaxial Cable Preparation Tools, U.S. Appl. No. 12/753,729, filed Apr. 2, 2010.

Montena, N. and Chawgo, S., Passive Intermodulation and Impedance Management in Coaxial Cable Terminations, U.S. Appl. No. 12/753,742, filed Apr. 2, 2010.

PCT/US2011/031011 International Search Report and Written Opinion. Date of Mailing: Oct. 31, 2011. 10 pages.

* cited by examiner

COAXIAL CABLE CONNECTOR

PRIORITY CLAIM

This application is a continuation of, and claims the benefit and priority of, U.S. patent application Ser. No. 13/784,499, filed on Mar. 4, 2013, which is a continuation of, and claims the benefit and priority of, U.S. patent application Ser. No. 13/093,937, filed on Apr. 26, 2011, now U.S. Pat. No. 8,388,375, which is a continuation of, and claims the benefit and priority of, U.S. patent application Ser. No. 12/753,735, filed on Apr. 2, 2010, now U.S. Pat. No. 7,934,954. The entire contents of such applications are hereby incorporated by reference.

BACKGROUND

Coaxial cable is used to transmit radio frequency (RF) signals in various applications, such as connecting radio transmitters and receivers with their antennas, computer network connections, and distributing cable television signals. Coaxial cable typically comprises an inner conductor, an insulating layer surrounding the inner conductor, an outer conductor surrounding the insulating layer, and a protective jacket surrounding the outer conductor.

Each type of coaxial cable has a characteristic impedance which is the opposition to signal flow in the coaxial cable. The impedance of a coaxial cable depends on its dimensions and the materials used in its manufacture. For example, a coaxial cable can be tuned to a specific impedance by controlling the diameters of the inner and outer conductors and the dielectric constant of the insulating layer. All of the components of a coaxial system should have the same impedance in order to reduce internal reflections at connections between components. Such reflections increase signal loss and can result in the reflected signal reaching a receiver with a slight delay from the original.

Two sections of a coaxial cable in which it can be difficult to maintain a consistent impedance are the terminal sections on either end of the cable to which connectors are attached. For example, the attachment of some field-installable compression connectors requires the removal of a section of the insulating layer at the terminal end of the coaxial cable in order to insert a support structure of the compression connector between the inner conductor and the outer conductor. The support structure of the compression connector prevents the collapse of the outer conductor when the compression connector applies pressure to the outside of the outer conductor. Unfortunately, however, the dielectric constant of the support structure often differs from the dielectric constant of the insulating layer that the support structure replaces, which changes the impedance of the terminal ends of the coaxial cable. This change in the impedance at the terminal ends of the coaxial cable causes increased internal reflections, which results in increased signal loss.

Another difficulty with field-installable connectors, such as compression connectors or screw-together connectors, is maintaining acceptable levels of passive intermodulation (PIM). PIM in the terminal sections of a coaxial cable can result from nonlinear and insecure contact between surfaces of various components of the connector. A nonlinear contact between two or more of these surfaces can cause micro arcing or corona discharge between the surfaces, which can result in the creation of interfering RF signals. For example, some screw-together connectors are designed such that the contact force between the connector and the outer conductor is dependent on a continuing axial holding force of threaded components of the connector. Over time, the threaded components of the connector can inadvertently separate, thus resulting in nonlinear and insecure contact between the connector and the outer conductor.

Where the coaxial cable is employed on a cellular communications tower, for example, unacceptably high levels of PIM in terminal sections of the coaxial cable and resulting interfering RF signals can disrupt communication between sensitive receiver and transmitter equipment on the tower and lower powered cellular devices. Disrupted communication can result in dropped calls or severely limited data rates, for example, which can result in dissatisfied customers and customer churn.

Current attempts to solve these difficulties with field-installable connectors generally consist of employing a pre-fabricated jumper cable having a standard length and having factory-installed soldered or welded connectors on either end. These soldered or welded connectors generally exhibit stable impedance matching and PIM performance over a wider range of dynamic conditions than current field-installable connectors. These pre-fabricated jumper cables are inconvenient, however, in many applications.

For example, each particular cellular communication tower in a cellular network generally requires various custom lengths of coaxial cable, necessitating the selection of various standard-length jumper cables that is each generally longer than needed, resulting in wasted cable. Also, employing a longer length of cable than is needed results in increased insertion loss in the cable. Further, excessive cable length takes up more space on the tower. Moreover, it can be inconvenient for an installation technician to have several lengths of jumper cable on hand instead of a single roll of cable that can be cut to the needed length. Also, factory testing of factory-installed soldered or welded connectors for compliance with impedance matching and PIM standards often reveals a relatively high percentage of noncompliant connectors. This percentage of non-compliant, and therefore unusable, connectors can be as high as about ten percent of the connectors in some manufacturing situations. For all these reasons, employing factory-installed soldered or welded connectors on standard-length jumper cables to solve the above-noted difficulties with field-installable connectors is not an ideal solution.

SUMMARY OF SOME EXAMPLE EMBODIMENTS

In general, example embodiments of the present invention relate to coaxial cable connectors. The example coaxial cable connectors disclosed herein improve impedance matching in coaxial cable terminations, thus reducing internal reflections and resulting signal loss associated with inconsistent impedance. Further, the example coaxial cable connectors disclosed herein also improve mechanical and electrical contacts in coaxial cable terminations, which reduces passive intermodulation (PIM) levels and associated creation of interfering RF signals that emanate from the coaxial cable terminations.

In one example embodiment, a coaxial cable connector for terminating a coaxial cable is provided. The coaxial cable comprises an inner conductor, an insulating layer surrounding the inner conductor, an outer conductor surrounding the insulating layer, and a jacket surrounding the outer conductor. The coaxial cable connector comprises an internal connector structure, an external connector structure, and a conductive pin. The external connector structure cooperates with the internal connector structure to define a cylindrical gap that is configured to receive an increased-diameter cylindrical section of the outer conductor. As the coaxial cable connector is moved from an open position to an engaged position, the external connector structure is configured to be clamped around the increased-diameter cylindrical section so as to radially compress the increased-diameter cylindrical section between the external connector structure and the internal connector structure. Further, as the coaxial cable connector is moved from an open position to an engaged position, a contact force between the conductive pin and the inner conductor is configured to increase.

In another example embodiment, a connector for terminating a corrugated coaxial cable is provided. The corrugated coaxial cable comprises an inner conductor, an insulating layer surrounding the inner conductor, a corrugated outer conductor having peaks and valleys and surrounding the insulating layer, and a jacket surrounding the corrugated outer conductor. The connector comprises a mandrel, a clamp, and a conductive pin. The mandrel has a cylindrical outside surface with a diameter that is greater than an inside diameter of valleys of the corrugated outer conductor. The clamp has a cylindrical inside surface that surrounds the cylindrical outside surface of the mandrel and cooperates with the mandrel to define a cylindrical gap. The cylindrical gap is configured to receive an increased-diameter cylindrical section of the corrugated outer conductor. As the coaxial cable connector is moved from an open position to an engaged position, the cylindrical inside surface is configured to be clamped around the increased-diameter cylindrical section so as to radially compress the increased-diameter cylindrical section between the clamp and the mandrel. Further, as the coaxial cable connector is moved from an open position to an engaged position, a contact force between the conductive pin and the inner conductor is configured to increase.

In yet another example embodiment, a connector for terminating a smooth-walled coaxial cable is provided. The smooth-walled coaxial cable comprises an inner conductor, an insulating layer surrounding the inner conductor, a smooth-walled outer conductor surrounding the insulating layer, and a jacket surrounding the smooth-walled outer conductor. The connector comprises a mandrel, a clamp, and a conductive pin. The mandrel has a cylindrical outside surface with a diameter that is greater than an inside diameter of the smooth-walled outer conductor. The clamp has a cylindrical inside surface that surrounds the cylindrical outside surface of the mandrel and cooperates with the mandrel to define a cylindrical gap. The cylindrical gap is configured to receive an increased-diameter cylindrical section of the smooth-walled outer conductor. As the coaxial cable connector is moved from an open position to an engaged position, the cylindrical inside surface is configured to be clamped around the increased-diameter cylindrical section so as to radially compress the increased-diameter cylindrical section between the clamp and the mandrel. Further, as the coaxial cable connector is moved from an open position to an engaged position, a contact force between the conductive pin and the inner conductor is configured to increase.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter. Moreover, it is to be understood that both the foregoing general description and the following detailed description of the present invention are exemplary and explanatory and are intended to provide further explanation of the invention as claimed.

BRIEF DESCRIPTION OF THE DRAWINGS

Aspects of example embodiments of the present invention will become apparent from the following detailed description of example embodiments given in conjunction with the accompanying drawings, in which.

DETAILED DESCRIPTION OF SOME EXAMPLE EMBODIMENTS

Example embodiments of the present invention relate to coaxial cable connectors. In the following detailed description of some example embodiments, reference will now be made in detail to example embodiments of the present invention which are illustrated in the accompanying drawings. Wherever possible, the same reference numbers will be used throughout the drawings to refer to the same or like parts. These embodiments are described in sufficient detail to enable those skilled in the art to practice the invention. Other embodiments may be utilized and structural, logical and electrical changes may be made without departing from the scope of the present invention. Moreover, it is to be understood that the various embodiments of the invention, although different, are not necessarily mutually exclusive. For example, a particular feature, structure, or characteristic described in one embodiment may be included within other embodiments. The following detailed description is, therefore, not to be taken in a limiting sense, and the scope of the present invention is defined only by the appended claims, along with the full scope of equivalents to which such claims are entitled.

I. Example Coaxial Cable and Example Compression Connector

Figure 1A:
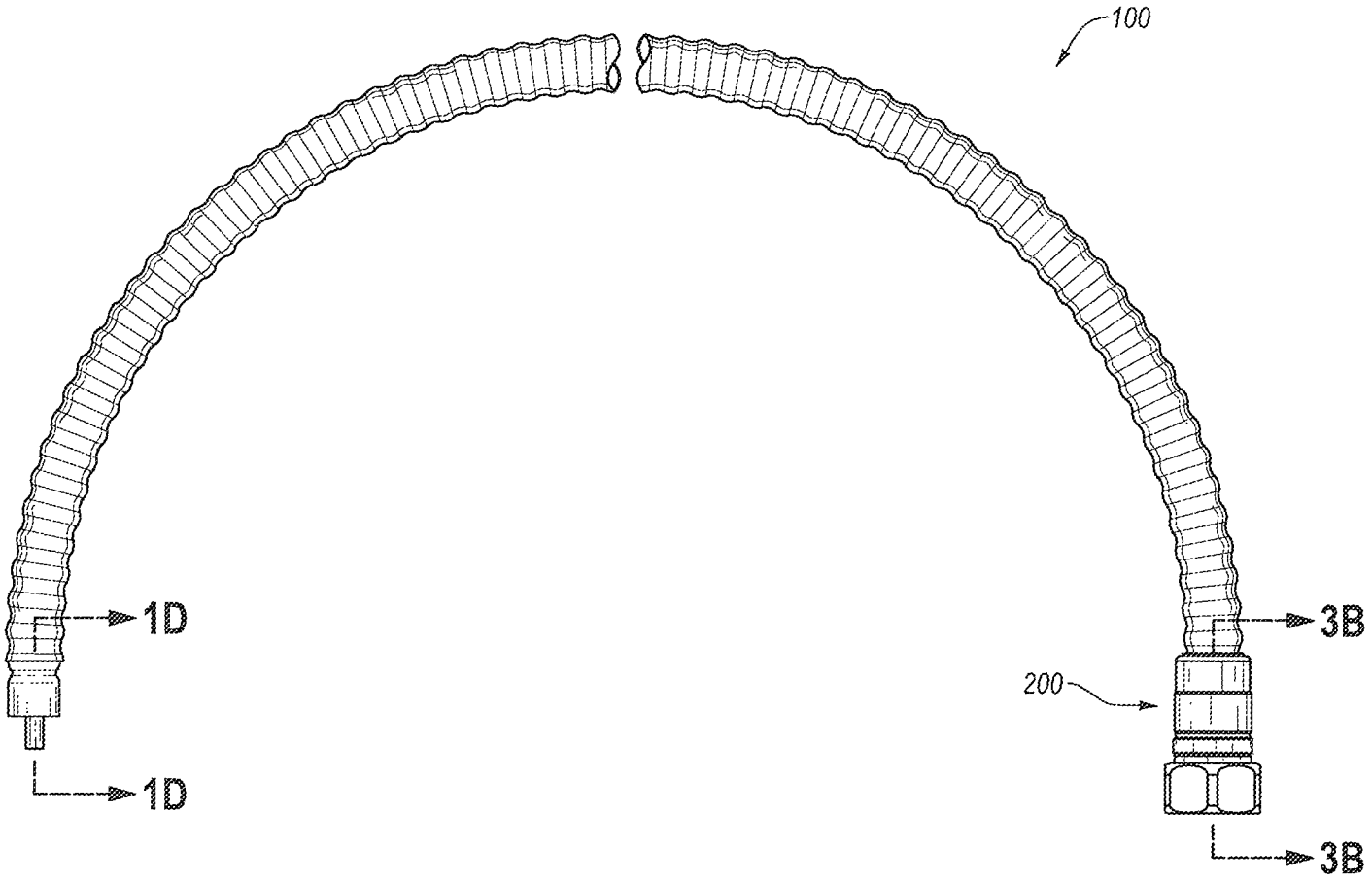
FIG. 1A is a perspective view of an example corrugated coaxial cable terminated on one end with an example compression connector.

With reference now to FIG. 1A, a first example coaxial cable 100 is disclosed. The example coaxial cable 100 has 50 Ohms of impedance and is a ½" series corrugated coaxial cable. It is understood, however, that these cable characteristics are example characteristics only, and that the example compression connectors disclosed herein can also benefit coaxial cables with other impedance, dimension, and shape characteristics.

Also disclosed in FIG. 1A, the example coaxial cable 100 is terminated on the right side of FIG. 1A with an example compression connector 200. Although the example compression connector 200 is disclosed in FIG. 1A as a male compression connector, it is understood that the compression connector 200 can instead be configured as a female compression connector (not shown).

Figure 1B:
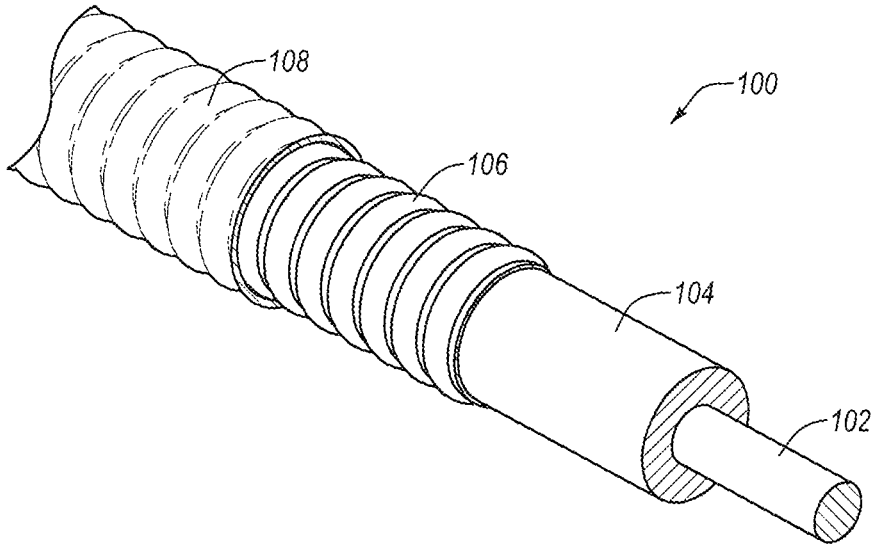
FIG. 1B is a perspective view of a portion of the example corrugated coaxial cable of FIG. 1A, the perspective view having portions of each layer of the example corrugated coaxial cable cut away.

With reference now to FIG. 1B, the coaxial cable 100 generally comprises an inner conductor 102 surrounded by an insulating layer 104, a corrugated outer conductor 106 surrounding the insulating layer 104, and a jacket 108 surrounding the corrugated outer conductor 106. As used herein, the phrase "surrounded by" refers to an inner layer generally being encased by an outer layer. However, it is understood that an inner layer may be "surrounded by" an outer layer without the inner layer being immediately adjacent to the outer layer. The term "surrounded by" thus allows for the possibility of intervening layers. Each of these components of the example coaxial cable 100 will now be discussed in turn.

The inner conductor 102 is positioned at the core of the example coaxial cable 100 and may be configured to carry a range of electrical current (amperes) and/or RF/electronic digital signals. The inner conductor 102 can be formed from copper, copper-clad aluminum (CCA), copper-clad steel (CCS), or silver-coated copper-clad steel (SCCCS), although other conductive materials are also possible. For example, the inner conductor 102 can be formed from any type of conductive metal or alloy. In addition, although the inner conductor 102 of FIG. 1B is clad, it could instead have other configurations such as solid, stranded, corrugated, plated, or hollow, for example.

The insulating layer 104 surrounds the inner conductor 102, and generally serves to support the inner conductor 102 and insulate the inner conductor 102 from the outer conductor 106. Although not shown in the figures, a bonding agent, such as a polymer, may be employed to bond the insulating layer 104 to the inner conductor 102. As disclosed in FIG. 1B, the insulating layer 104 is formed from a foamed material such as, but not limited to, a foamed polymer or fluoropolymer. For example, the insulating layer 104 can be formed from foamed polyethylene (PE).

The corrugated outer conductor 106 surrounds the insulating layer 104, and generally serves to minimize the ingress and egress of high frequency electromagnetic radiation to/from the inner conductor 102. In some applications, high frequency electromagnetic radiation is radiation with a frequency that is greater than or equal to about 50 MHz. The corrugated outer conductor 106 can be formed from solid copper, solid aluminum, copper-clad aluminum (CCA), although other conductive materials are also possible. The corrugated configuration of the corrugated outer conductor 106, with peaks and valleys, enables the coaxial cable 100 to be flexed more easily than cables with smooth-walled outer conductors.

The jacket 108 surrounds the corrugated outer conductor 106, and generally serves to protect the internal components of the coaxial cable 100 from external contaminants, such as dust, moisture, and oils, for example. In a typical embodiment, the jacket 108 also functions to limit the bending radius of the cable to prevent kinking, and functions to protect the cable (and its internal components) from being crushed or otherwise misshapen from an external force. The jacket 108 can be formed from a variety of materials including, but not limited to, polyethylene (PE), high-density polyethylene (HDPE), low-density polyethylene (LDPE), linear low-density polyethylene (LLDPE), rubberized polyvinyl chloride (PVC), or some combination thereof. The actual material used in the formation of the jacket 108 might be indicated by the particular application/environment contemplated.

It is understood that the insulating layer 104 can be formed from other types of insulating materials or structures having a dielectric constant that is sufficient to insulate the inner conductor 102 from the outer conductor 106. For example, as disclosed in FIG. 1C, an alternative coaxial cable 100' comprises an alternative insulating layer 104' composed of a spiral-shaped spacer that enables the inner conductor 102 to be generally separated from the corrugated outer conductor 106 by air. The spiral-shaped spacer of the alternative insulating layer 104' may be formed from polyethylene or polypropylene, for example. The combined dielectric constant of the spiral-shaped spacer and the air in the alternative insulating layer 104' would be sufficient to insulate the inner conductor 102 from the corrugated outer conductor 106 in the alternative coaxial cable 100'. Further, the example compression connector 200 disclosed herein can similarly benefit the alternative coaxial cable 100'.

Figure 1C:
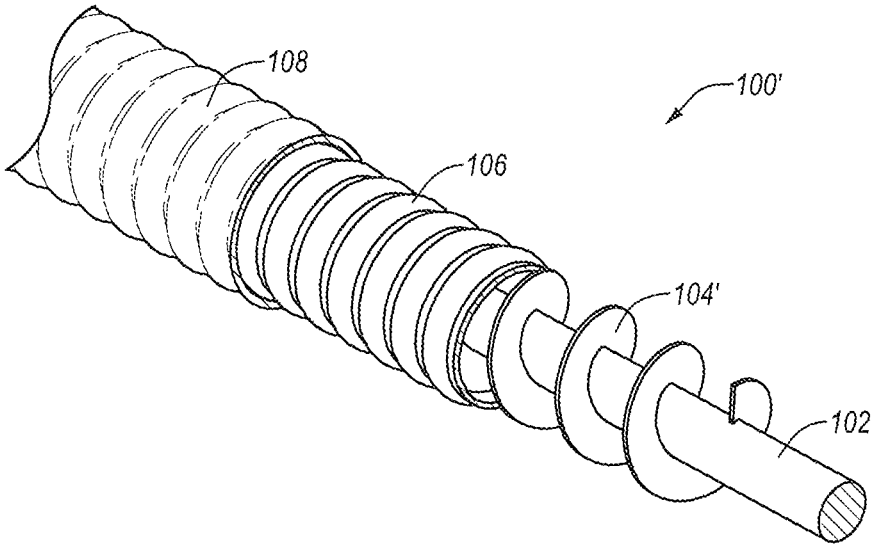
FIG. 1C is a perspective view of a portion of an alternative corrugated coaxial cable, the perspective view having portions of each layer of the alternative corrugated coaxial cable cut away.
Figure 1D:
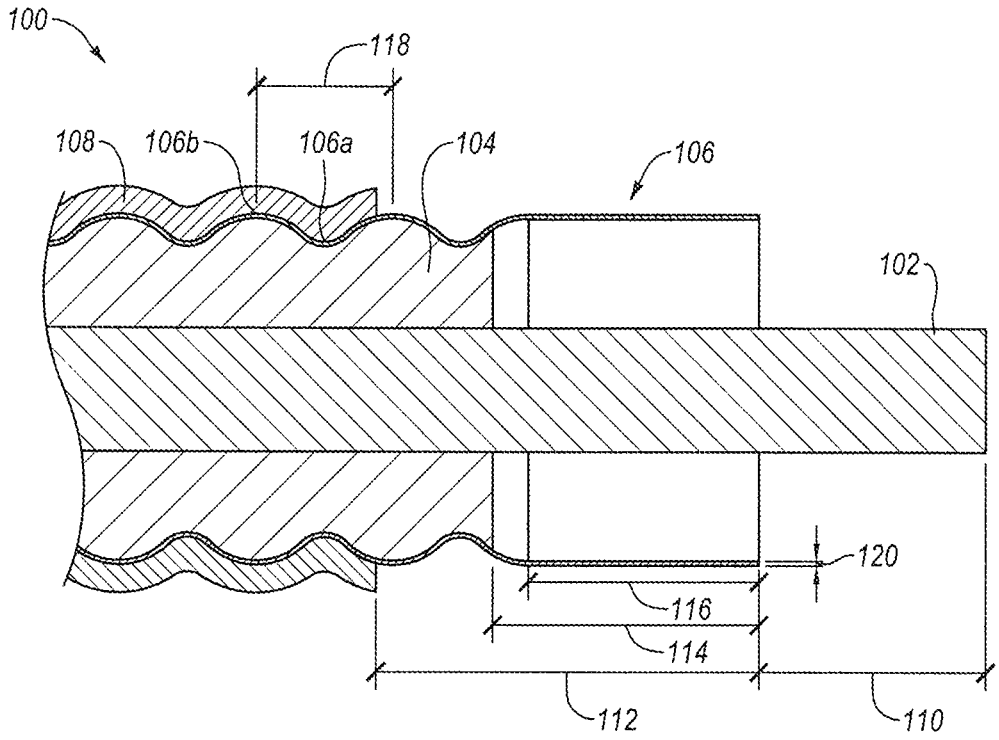
FIG. 1D is a cross-sectional side view of a terminal end of the example corrugated coaxial cable of FIG. 1A after having been prepared for termination with the example compression connector of FIG. 1A.

With reference to FIG. 1D, a terminal end of the coaxial cable 100 is disclosed after having been prepared for termination with the example compression connector 200, disclosed in FIGS. 1A and 2A-3B. As disclosed in FIG. 1D, the terminal end of the coaxial cable 100 comprises a first section 110, a second section 112, a cored-out section 114, and an increased-diameter cylindrical section 116. The jacket 108, corrugated outer conductor 106, and insulating layer 104 have been stripped away from the first section 110. The jacket 108 has been stripped away from the second section 112. The insulating layer 104 has been cored out from the cored out section 114. The diameter of a portion of the corrugated outer conductor 106 that surrounds the cored-out section 114 has been increased so as to create the increased-diameter cylindrical section 116 of the outer conductor 106.

The term "cylindrical" as used herein refers to a component having a section or surface with a substantially uniform diameter throughout the length of the section or surface. It is understood, therefore, that a "cylindrical" section or surface may have minor imperfections or irregularities in the roundness or consistency throughout the length of the section or surface. It is further understood that a "cylindrical" section or surface may have an intentional distribution or pattern of features, such as grooves or teeth, but nevertheless on average has a substantially uniform diameter throughout the length of the section or surface.

This increasing of the diameter of the corrugated outer conductor 106 can be accomplished using any of the tools disclosed in co-pending U.S. patent application Ser. No. 12/753,729, titled "COAXIAL CABLE PREPARATION TOOLS," filed Apr. 2, 2010 and incorporated herein by reference in its entirety. Alternatively, this increasing of the diameter of the corrugated outer conductor 106 can be accomplished using other tools, such as a common pipe expander.

As disclosed in FIG. 1D, the increased-diameter cylindrical section 116 can be fashioned by increasing a diameter of one or more of the valleys 106*a* of the corrugated outer conductor 106 that surround the cored-out section 114. For example, as disclosed in FIG. 1D, the diameters of one or more of the valleys 106*a* can be increased until they are equal to the diameters of the peaks 106*b*, resulting in the increased-diameter cylindrical section 116 disclosed in FIG. 1D. It is understood, however, that the diameter of the increased-diameter cylindrical section 116 of the outer conductor 106 can be greater than the diameter of the peaks 106*b* of the example corrugated coaxial cable 100. Alternatively, the diameter of the increased-diameter cylindrical section 116 of the outer conductor 106 can be greater than the diameter of the valleys 106*a* but less than the diameter of the peaks 106*b*.

As disclosed in FIG. 1D, the increased-diameter cylindrical section 116 of the corrugated outer conductor 106 has a substantially uniform diameter throughout the length of the increased-diameter cylindrical section 116. It is understood that the length of the increased-diameter cylindrical section 116 should be sufficient to allow a force to be directed inward on the increased-diameter cylindrical section 116, once the corrugated coaxial cable 100 is terminated with the example compression connector 200, with the inwardly-directed force having primarily a radial component and having substantially no axial component.

As disclosed in FIG. 1D, the increased-diameter cylindrical section 116 of the corrugated outer conductor 106 has a length greater than the distance 118 spanning the two adjacent peaks 106*b* of the corrugated outer conductor 106. More particularly, the length of the increased-diameter cylindrical section 116 is thirty three times the thickness 120 of the outer conductor 106. It is understood, however, that the length of the increased-diameter cylindrical section 116 could be any length from two times the thickness 120 of the outer conductor 106 upward. It is further understood that the tools and/or processes that fashion the increased-diameter cylindrical section 116 may further create increased-diameter portions of the corrugated outer conductor 106 that are not cylindrical.

The preparation of the terminal section of the example corrugated coaxial cable 100 disclosed in FIG. 1D can be accomplished by employing the example method 400 disclosed in co-pending U.S. patent application Ser. No. 12/753,742, titled "PASSIVE INTERMODULATION AND IMPEDANCE MANAGEMENT IN COAXIAL CABLE TERMINATIONS," filed Apr. 2, 2010 and incorporated herein by reference in its entirety.

Although the insulating layer 104 is shown in FIG. 1D as extending all the way to the top of the peaks 106*b* of the corrugated outer conductor 106, it is understood that an air gap may exist between the insulating layer 104 and the top of the peaks 106*b*. Further, although the jacket 108 is shown in the FIG. 1D as extending all the way to the bottom of the valleys 106*a* of the corrugated outer conductor 106, it is understood that an air gap may exist between the jacket 108 and the bottom of the valleys 106*a*.

In addition, it is understood that the corrugated outer conductor 106 can be either annular corrugated outer conductor, as disclosed in the figures, or can be helical corrugated outer conductor (not shown). Further, the example compression connectors disclosed herein can similarly benefit a coaxial cable with a helical corrugated outer conductor (not shown).

II. Example Compression Connector

Figure 2A:
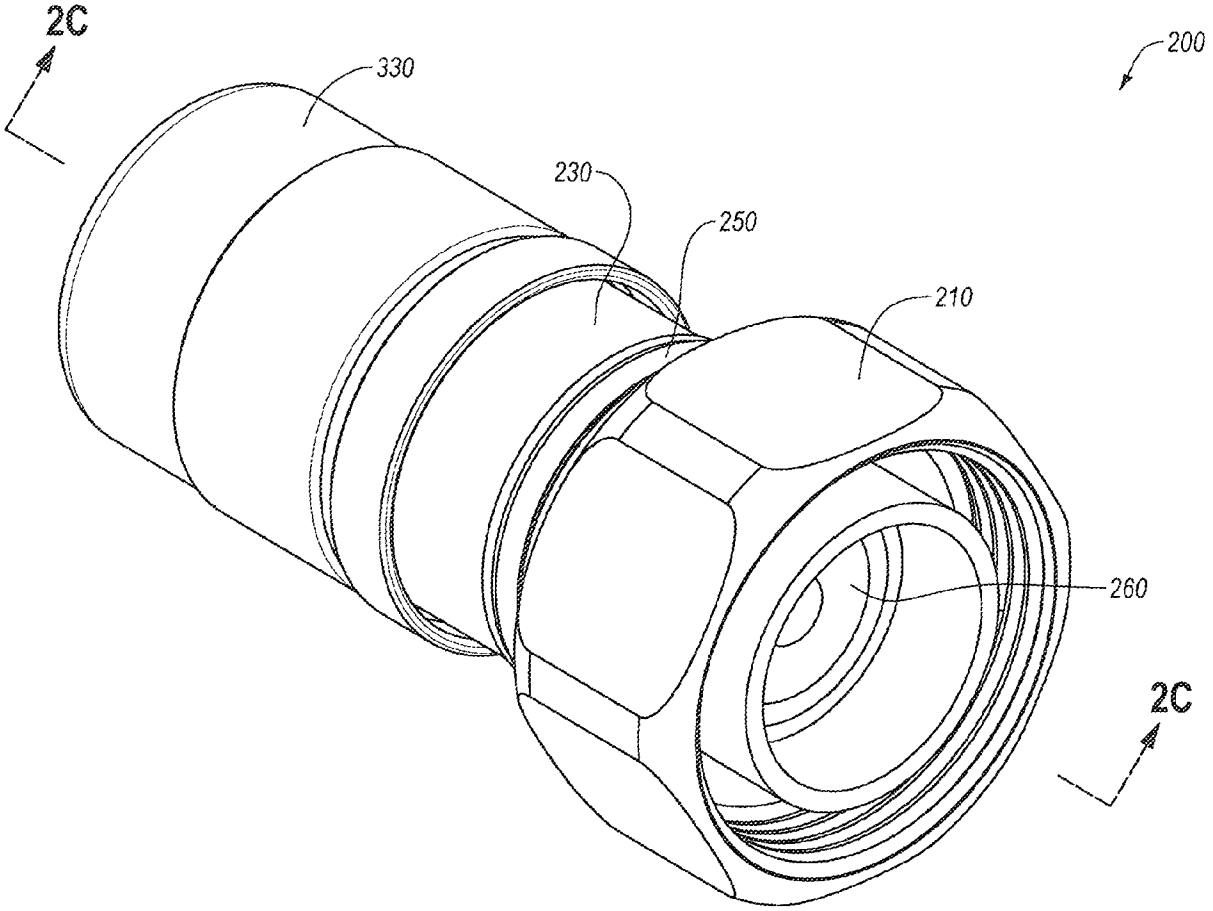
FIG. 2A is a perspective view of the example compression connector of FIG. 1A.
Figure 2B:
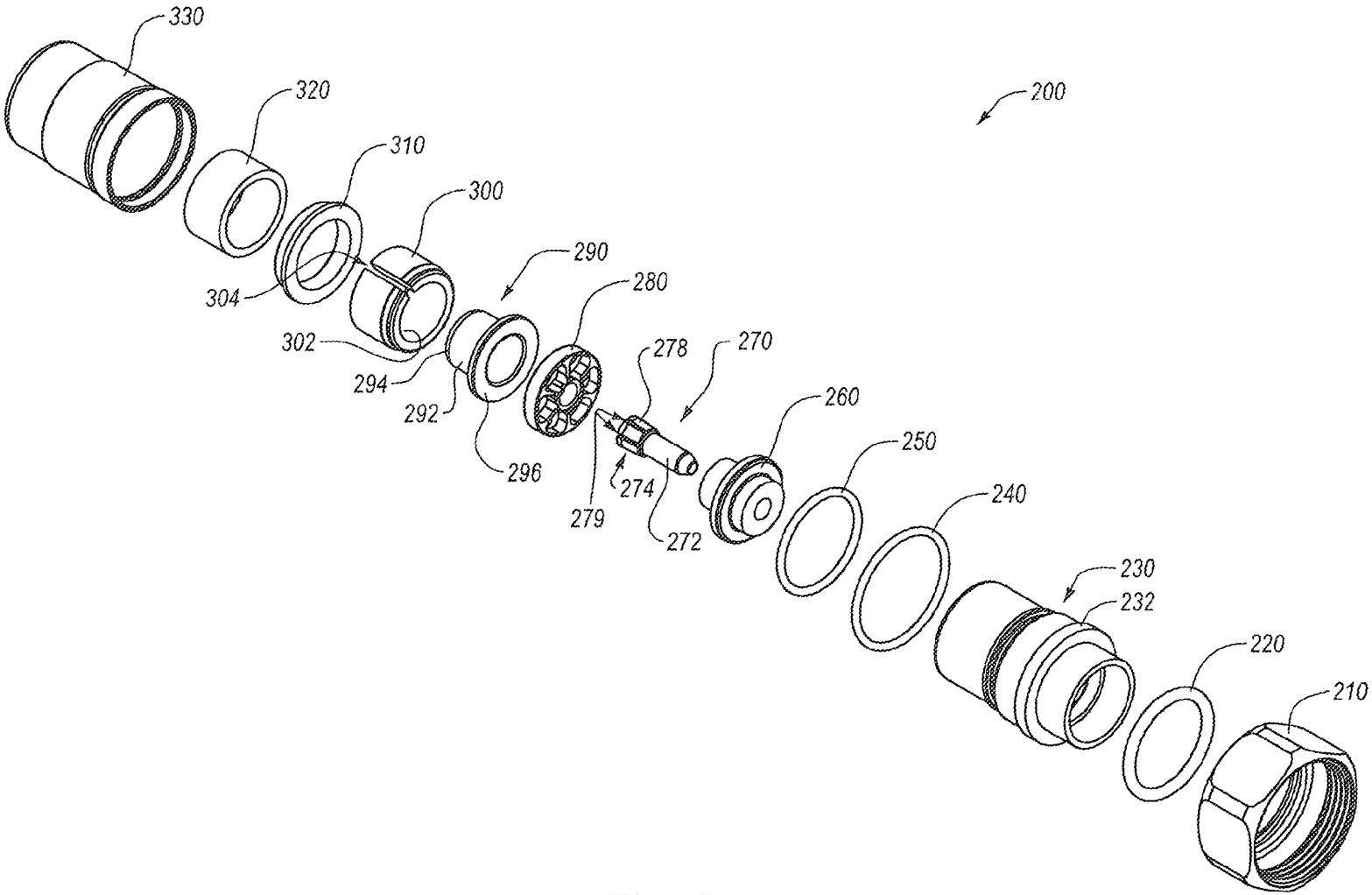
FIG. 2B is an exploded view of the example compression connector of FIG. 2A.
Figure 2C:
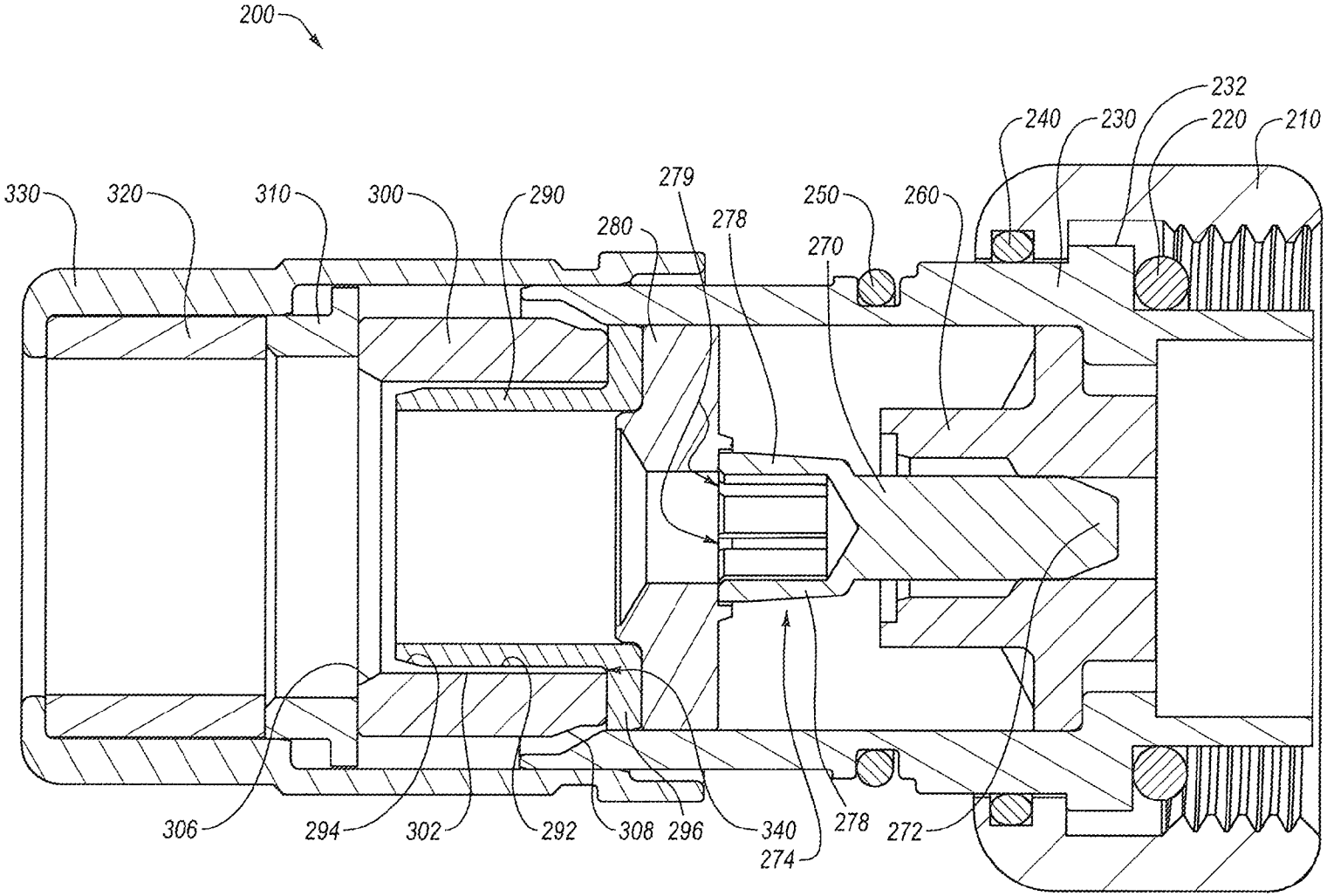
FIG. 2C is a cross-sectional side view of the example compression connector of FIG. 2A.

With reference now to FIGS. 2A-2C, additional aspects of the example compression connector 200 are disclosed. As disclosed in FIGS. 2A-2C, the example compression connector 200 comprises a connector nut 210, a first o-ring seal 220, a connector body 230, a second o-ring seal 240, a third o-ring seal 250, an insulator 260, a conductive pin 270, a driver 280, a mandrel 290, a clamp 300, a clamp ring 310, a jacket seal 320, and a compression sleeve 330.

As disclosed in FIGS. 2B and 2C, the connector nut 210 is connected to the connector body 230 via an annular flange 232. The insulator 260 positions and holds the conductive pin 270 within the connector body 230. The conductive pin 270 comprises a pin portion 272 at one end and a collet portion 274 at the other end. The collet portion 274 comprises fingers 278 separated by slots 279. The slots 279 are configured to narrow or close as the compression connector 200 is moved from an open position (as disclosed in FIG. 3A) to an engaged position (as disclosed in FIG. 3B), as discussed in greater detail below. The collet portion 274 is configured to receive and surround an inner conductor of a coaxial cable. The driver 280 is positioned inside connector body 230 between the collet portion 274 of the conductive pin 270 and the mandrel 290. The mandrel 290 abuts the clamp 300. The clamp 300 abuts the clamp ring 310, which abuts the jacket seal 320, both of which are positioned within the compression sleeve 330.

The mandrel 290 is an example of an internal connector structure as at least a portion of the mandrel 290 is configured to be positioned internal to a coaxial cable. The clamp 300 is an example of an external connector structure as at least a portion of the clamp 300 is configured to be positioned external to a coaxial cable. The mandrel 290 has a cylindrical outside surface 292 that is surrounded by a cylindrical inside surface 302 of the clamp 300. The cylindrical outside surface 292 cooperates with the cylindrical inside surface 302 to define a cylindrical gap 340.

The mandrel 290 further has an inwardly-tapering outside surface 294 adjacent to one end of the cylindrical outside surface 292, as well as an annular flange 296 adjacent to the other end of the cylindrical outside surface 292. As disclosed in FIG. 2B, the clamp 300 defines a slot 304 running the length of the clamp 300. The slot 304 is configured to narrow or close as the compression connector 200 is moved from an open position (as disclosed in FIG. 3A) to an engaged position (as disclosed in FIG. 3B), as discussed in greater detail below. Further, as disclosed in FIG. 2C, the clamp 300 further has an outwardly-tapering surface 306 adjacent to the cylindrical inside surface 302. Also, the clamp 300 further has an inwardly-tapering outside transition surface 308.

Although the majority of the outside surface of the mandrel 290 and the inside surface of the clamp 300 are cylindrical, it is understood that portions of these surfaces may be non-cylindrical. For example, portions of these surfaces may include steps, grooves, or ribs in order achieve mechanical and electrical contact with the increased-diameter cylindrical section 116 of the example coaxial cable 100.

For example, the outside surface of the mandrel 290 may include a rib that corresponds to a cooperating groove included on the inside surface of the clamp 300. In this example, the compression of the increased-diameter cylindrical section 116 between the mandrel 290 and the clamp 300 will cause the rib of the mandrel 290 to deform the increased-diameter cylindrical section 116 into the cooperating groove of the clamp 300. This can result in improved mechanical and/or electrical contact between the clamp 300, the increased-diameter cylindrical section 116, and the mandrel 290. In this example, the locations of the rib and the cooperating groove can also be reversed. Further, it is understood that at least portions of the surfaces of the rib and the cooperating groove can be cylindrical surfaces. Also, multiple rib/cooperating groove pairs may be included on the mandrel 290 and/or the clamp 300. Therefore, the outside surface of the mandrel 290 and the inside surface of the clamp 300 are not limited to the configurations disclosed in the figures.

III. Cable Termination Using the Example Compression Connector

Figure 3A:
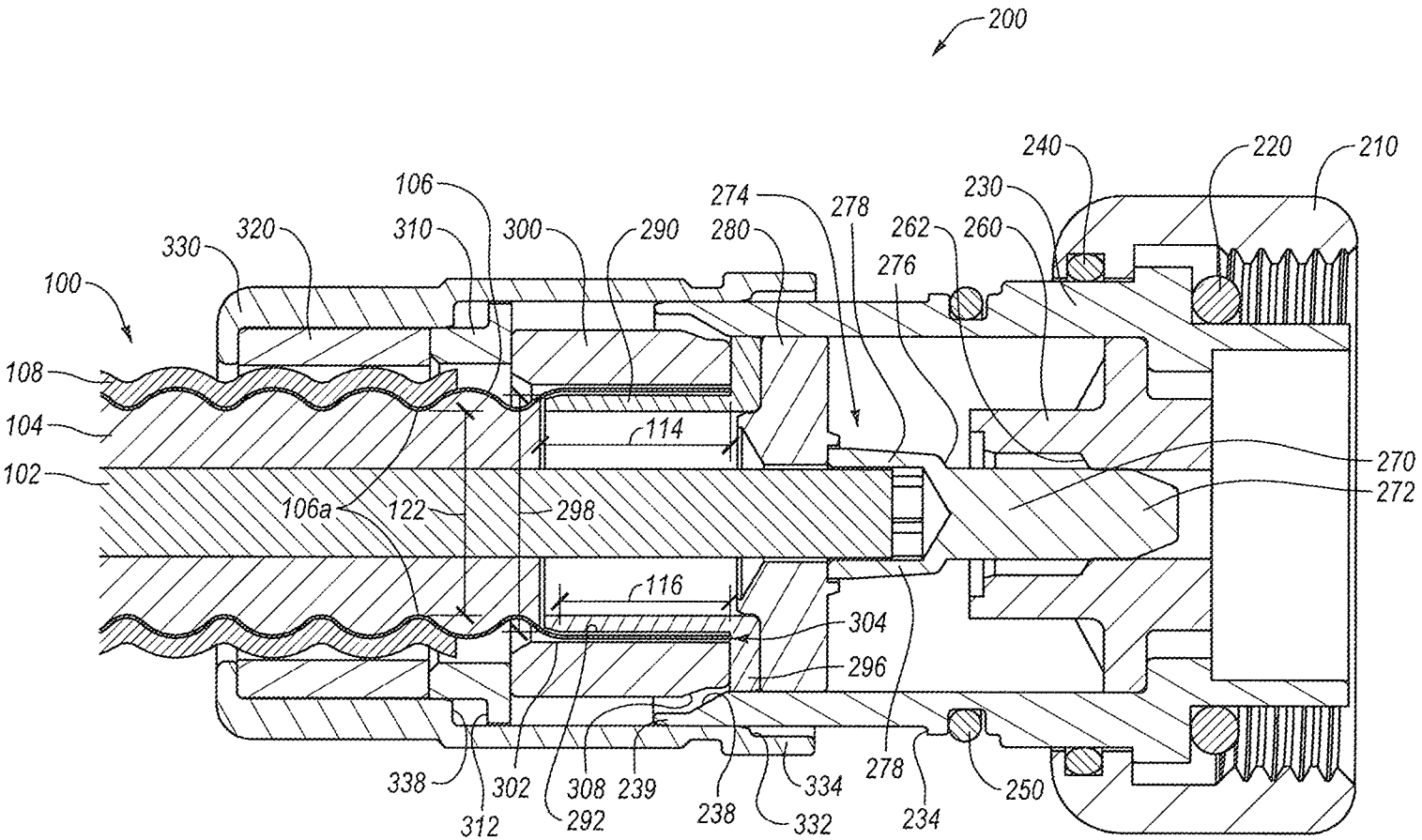
FIG. 3A is a cross-sectional side view of the terminal end of the example corrugated coaxial cable of FIG. 1D after having been inserted into the example compression connector of FIG. 2C, with the example compression connector being in an open position.
Figure 3B:
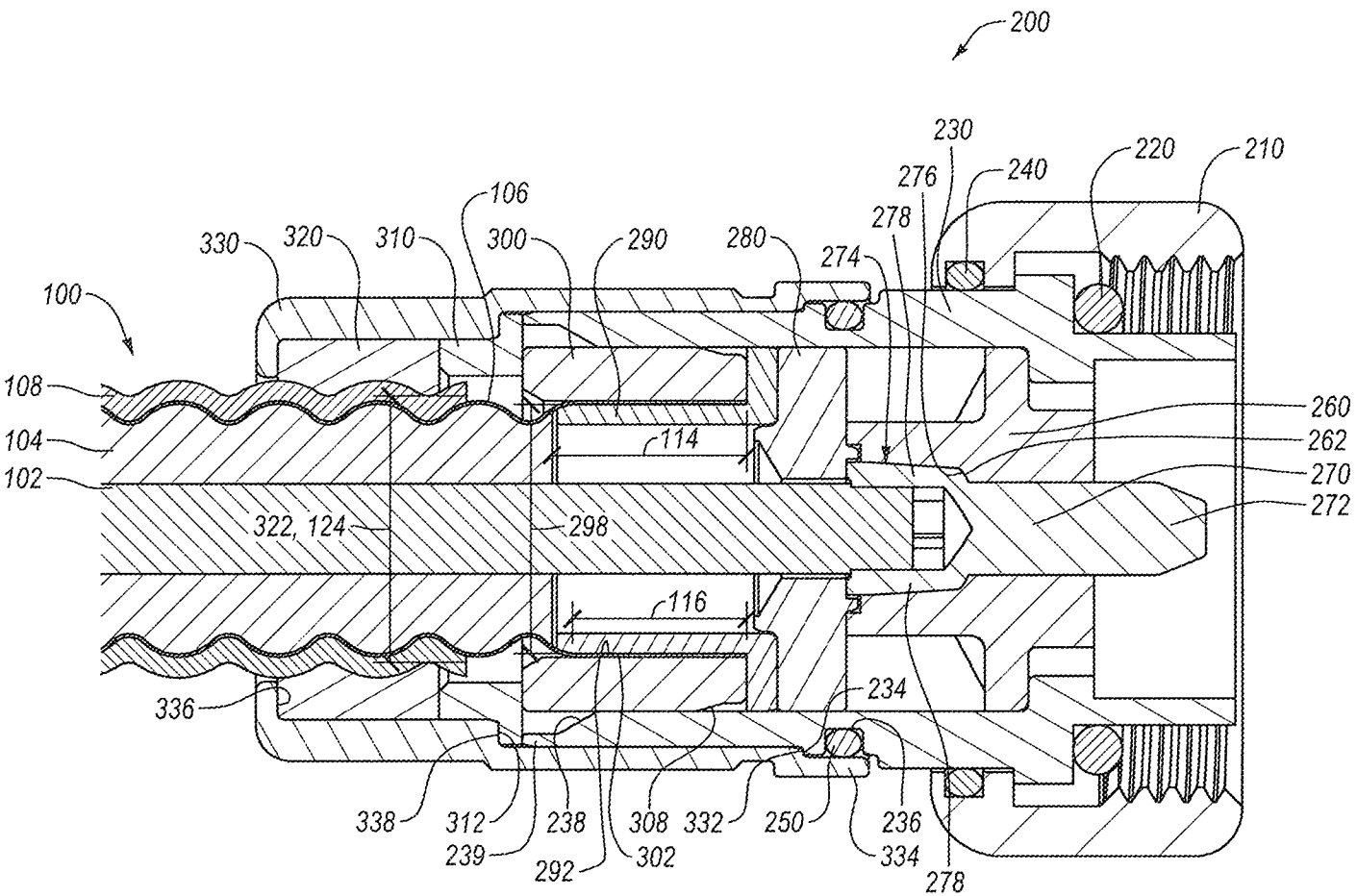
FIG. 3B is a cross-sectional side view of the terminal end of the example corrugated coaxial cable of FIG. 1D after having been inserted into the example compression connector of FIG. 3A, with the example compression connector being in an engaged position.

With reference now to FIGS. 3A and 3B, additional aspects of the operation of the example compression connector 200 are disclosed. In particular, FIG. 3A discloses the example compression connector 200 in an initial open position, while FIG. 3B discloses the example compression connector 200 after having been moved into an engaged position.

As disclosed in FIG. 3A, the terminal end of the corrugated coaxial cable 100 of FIG. 1D can be inserted into the example compression connector 200 through the compression sleeve 330. Once inserted, the increased-diameter cylindrical section 116 of the outer conductor 106 is received into the cylindrical gap 304 defined between the cylindrical outside surface 292 of the mandrel 290 and the cylindrical inside surface 302 of the clamp 300. Also, once inserted, the jacket seal 320 surrounds the jacket 108 of the corrugated coaxial cable 100, and the inner conductor 102 is received into the collet portion 274 of the conductive pin 270 such that the conductive pin 270 is mechanically and electrically contacting the inner conductor 102. As disclosed in FIG. 3A, the diameter 298 of the cylindrical outside surface 292 of the mandrel 290 is greater than the smallest diameter 122 of the corrugated outer conductor 106, which is the inside diameter of the valleys 106*a* of the outer conductor 106.

FIG. 3B discloses the example compression connector 200 after having been moved into an engaged position. As disclosed in FIGS. 3A and 3B, the example compression connector 200 is moved into the engaged position by sliding the compression sleeve 330 along the connector body 230 toward the connector nut 210. As the compression connector 200 is moved into the engaged position, the inside of the compression sleeve 330 slides over the outside of the connector body 230 until a shoulder 332 of the compression sleeve 330 abuts a shoulder 234 of the connector body 230. In addition, a distal end 334 of the compression sleeve 330 compresses the third o-ring seal 250 into an annular groove 236 defined in the connector body 230, thus sealing the compression sleeve 330 to the connector body 230.

Further, as the compression connector 200 is moved into the engaged position, a shoulder 336 of the compression sleeve 330 axially biases against the jacket seal 320, which axially biases against the clamp ring 310, which axially forces the inwardly-tapering outside transition surface 308 of the clamp 300 against an outwardly-tapering inside surface 238 of the connector body 230. As the surfaces 308 and 238 slide past one another, the clamp 300 is radially forced into the smaller diameter connector body 230, which radially compresses the clamp 300 and thus reduces the outer diameter of the clamp 300 by narrowing or closing the slot 304 (see FIG. 2B). As the clamp 300 is radially compressed by the axial force exerted on the compression sleeve 330, the cylindrical inside surface 302 of the clamp 300 is clamped around the increased-diameter cylindrical section 116 of the outer conductor 106 so as to radially compress the increased-diameter cylindrical section 116 between the cylindrical inside surface 302 of the clamp 300 and the cylindrical outside surface 292 of the mandrel 290.

In addition, as the compression connector 200 is moved into the engaged position, the clamp 300 axially biases against the annular flange 296 of the mandrel 290, which axially biases against the conductive pin 270, which axially forces the conductive pin 270 into the insulator 260 until a shoulder 276 of the collet portion 274 abuts a shoulder 262 of the insulator 260. As the collet portion 274 is axially forced into the insulator 260, the fingers 278 of the collet portion 274 are radially contracted around the inner conductor 102 by narrowing or closing the slots 279 (see FIG. 2B). This radial contraction of the conductive pin 270 results in an increased contact force between the conductive pin 270 and the inner conductor 102, and can also result in some deformation of the inner conductor 102, the insulator 260, and/or the fingers 278. As used herein, the term "contact force" is the combination of the net friction and the net normal force between the surfaces of two components. This contracting configuration increases the reliability of the mechanical and electrical contact between the conductive pin 270 and the inner conductor 102. Further, the pin portion 272 of the conductive pin 270 extends past the insulator 260 in order to engage a corresponding conductor of a female connector that is engaged with the connector nut 210 (not shown).

Figure 3C:
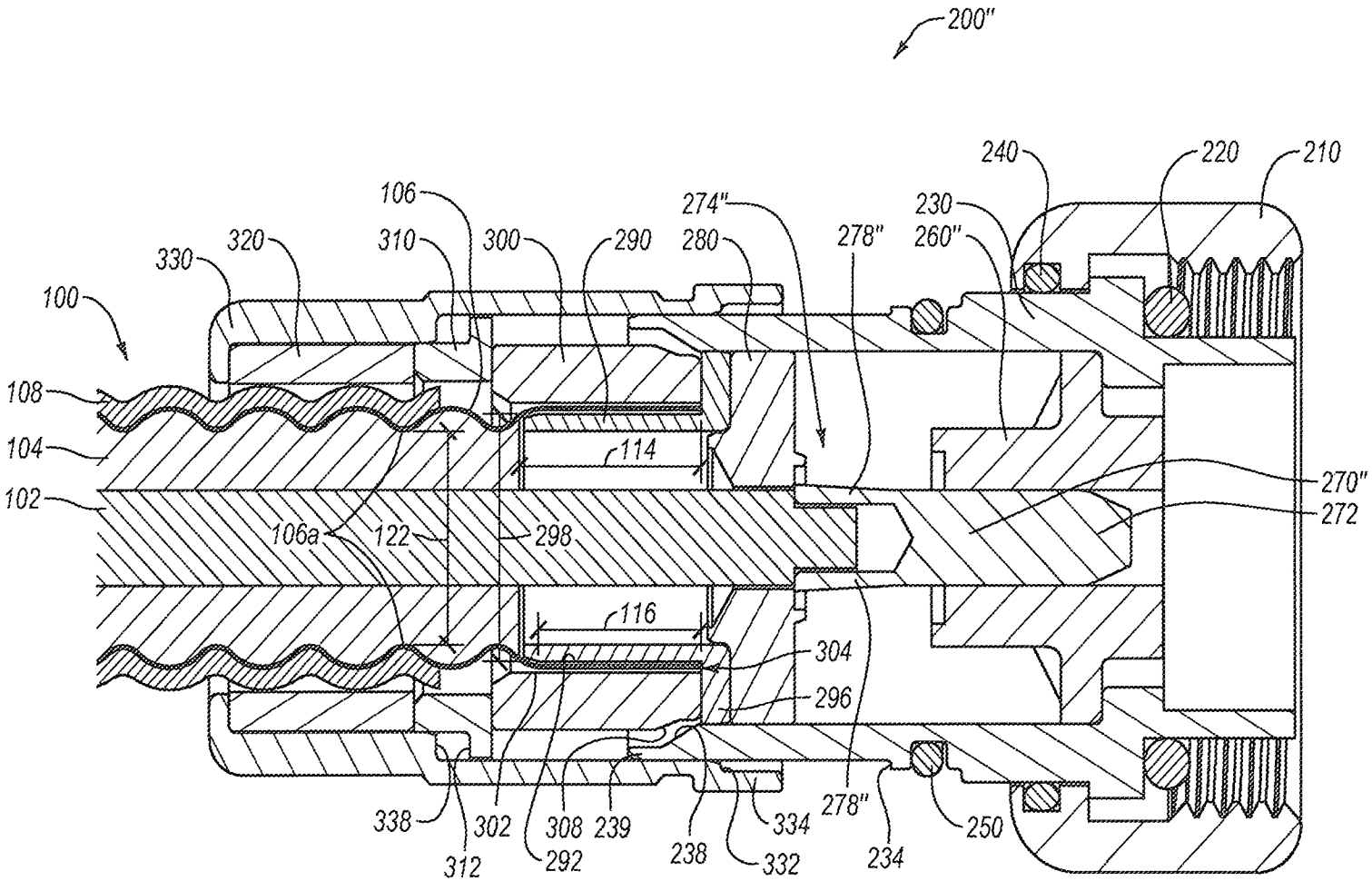
FIG. 3C is a cross-sectional side view of the terminal end of the example corrugated coaxial cable of FIG. 1D after having been inserted into another example compression, with the example compression connector being in an open position.
Figure 3D:
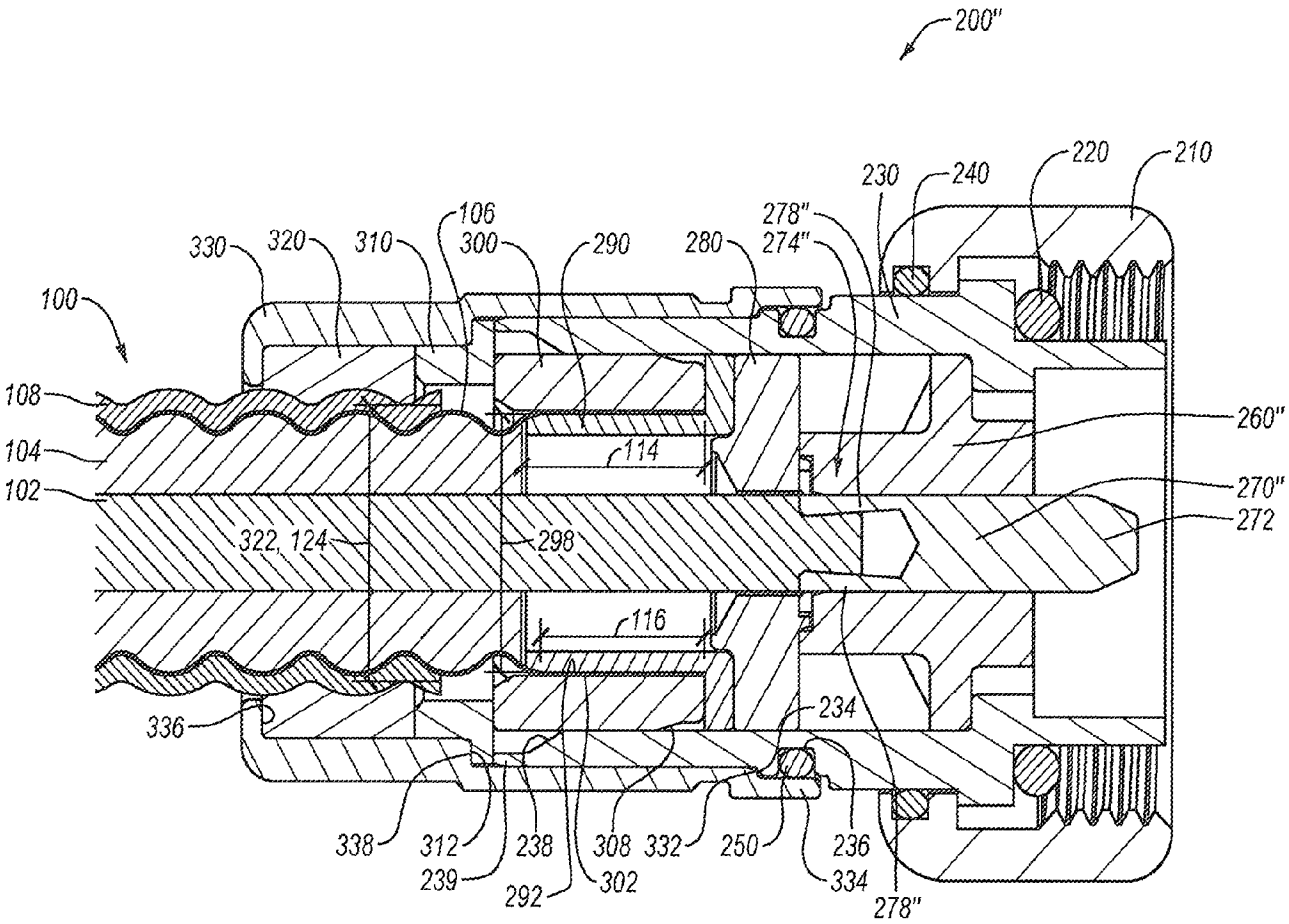
FIG. 3D is a cross-sectional side view of the terminal end of the example corrugated coaxial cable of FIG. 1D after having been inserted into the example compression connector of FIG. 3C, with the example compression connector being in an engaged position.

With reference now to FIGS. 3C and 3D, aspects of another example compression connector 200" are disclosed. In particular, FIG. 3C discloses the example compression connector 200" in an initial open position, while FIG. 3D discloses the example compression connector 200" after having been moved into an engaged position. The example compression connector 200" is identical to the example compression connector 200 in FIGS. 1A and 2A-3B, except that the example compression connector 200" has a modified insulator 260" and a modified conductive pin 270". As disclosed in FIGS. 3C and 3D, during the preparation of the terminal end of the coaxial cable 100, the diameter of the portion of the inner conductor 102 that is configured to be received into the collet portion 274" can be reduced. This additional diameter-reduction in the inner conductor 102 enables the collet portion 274" to be modified to have the same or similar outside diameter as the pin portion 272 (excluding the taper at the tip of the pin portion 272), instead of the enlarged diameter of the collet portion 274 disclosed in FIGS. 3A and 3B. Once the compression connector 200" has been moved into the engaged position, as disclosed in FIG. 3D, the outside diameter of the collet portion 274" is substantially equal to the outside diameter of the inner conductor. This additional diameter-reduction in the inner conductor 102 thus enables the outside diameter of the inner conductor 102, through which the RF signal travels, to remain substantially constant at the transition between the inner conductor 102 and the conductive pin 270". Since impedance is a function of the diameter of the inner conductor, as discussed in greater detail below, this additional diameter-reduction in the inner conductor 102 can further improve impedance matching between the coaxial cable 100 and the compression connector 200".

With continued reference to FIGS. 3A and 3B, as the compression connector 200 is moved into the engaged position, the distal end 239 of the connector body 230 axially biases against the clamp ring 310, which axially biases against the jacket seal 320 until a shoulder 312 of the clamp ring 310 abuts a shoulder 338 of the compression sleeve 330. The axial force of the shoulder 336 of the compression sleeve 330 combined with the opposite axial force of the clamp ring 310 axially compresses the jacket seal 320 causing the jacket seal 320 to become shorter in length and thicker in width. The thickened width of the jacket seal 320 causes the jacket seal 320 to press tightly against the jacket 108 of the corrugated coaxial cable 100, thus sealing the compression sleeve 330 to the jacket 108 of the corrugated coaxial cable 100. Once sealed, in at least some example embodiments, the narrowest inside diameter 322 of the jacket seal 320, which is equal to the outside diameter 124 of the valleys of jacket 108, is less than the sum of the diameter 298 of the cylindrical outside surface 292 of the mandrel 290 plus two times the average thickness of the jacket 108.

With reference to FIG. 2B, the mandrel 290 and the clamp 300 are both formed from metal, which makes the mandrel 290 and the clamp 300 relatively sturdy. As disclosed in FIGS. 3A and 3B, with both the mandrel 290 and the clamp 300 formed from metal, two separate electrically conductive paths exist between the outer conductor 106 and the connector body 230. Although these two paths merge where the clamp 300 makes contact with the annular flange 296 of the mandrel 290, as disclosed in FIG. 3B, it is understood that these paths may alternatively be separated by creating a substantial gap between the clamp 300 and the annular flange 296. This substantial gap may further be filled or partially filled with an insulating material, such as a plastic washer for example, to better ensure electrical isolation between the clamp 300 and the annular flange 296.

Also disclosed in FIGS. 3A and 3B, the thickness of the metal inserted portion of the mandrel 290 is about equal to the difference between the inside diameter of the peaks 106*b* (FIG. 1D) of the corrugated outer conductor 106 and the inside diameter of the valleys 106*a* (FIG. 1D) of the corrugated outer conductor 106. It is understood, however, that the thickness of the metal inserted portion of the mandrel 290 could be greater than or less than the thickness disclosed in FIGS. 3A and 3B.

It is understood that one of the mandrel 290 or the clamp 300 can alternatively be formed from a non-metal material such as polyetherimide (PEI) or polycarbonate, or from a metal/non-metal composite material such as a selectively metal-plated PEI or polycarbonate material. A selectively metal-plated mandrel 290 or clamp 300 may be metal-plated at contact surfaces where the mandrel 290 or the clamp 300 makes contact with another component of the compression connector 200. Further, bridge plating, such as one or more metal traces, can be included between these metal-plated contact surfaces in order to ensure electrical continuity between the contact surfaces. It is understood that only one of these two components needs to be formed from metal or from a metal/non-metal composite material in order to create a single electrically conductive path between the outer conductor 106 and the connector body 230.

The increased-diameter cylindrical section 116 of the outer conductor 106 enables the inserted portion of the mandrel 290 to be relatively thick and to be formed from a material with a relatively high dielectric constant and still maintain favorable impedance characteristics. Also disclosed in FIGS. 3A and 3B, the metal inserted portion of the mandrel 290 has an inside diameter that is about equal to the inside diameter 122 of the valleys 106*a* of the corrugated outer conductor 106. It is understood, however, that the inside diameter of the metal inserted portion of the mandrel 290 could be greater than or less than the inside diameter disclosed in FIGS. 3A and 3B. For example, the metal inserted portion of the mandrel 290 can have an inside diameter that is about equal to an average diameter of the valleys 106*a* and the peaks 106*b* (FIG. 1D) of the corrugated outer conductor 106.

Once inserted, the mandrel 290 replaces the material from which the insulating layer 104 is formed in the cored-out section 114. This replacement changes the dielectric constant of the material positioned between the inner conductor 102 and the outer conductor 106 in the cored-out section 114. Since the impedance of the coaxial cable 100 is a function of the diameters of the inner and outer conductors 102 and 106 and the dielectric constant of the insulating layer 104, in isolation this change in the dielectric constant would alter the impedance of the cored-out section 114 of the coaxial cable 100. Where the mandrel 290 is formed from a material that has a significantly different dielectric constant from the dielectric constant of the insulating layer 104, this change in the dielectric constant would, in isolation, significantly alter the impedance of the cored-out section 114 of the coaxial cable 100.

However, the increase of the diameter of the outer conductor 106 of the increased-diameter cylindrical section 116 is configured to compensate for the difference in the dielectric constant between the removed insulating layer 104 and the inserted portion of the mandrel 290 in the cored-out section 114. Accordingly, the increase of the diameter of the outer conductor 106 in the increased-diameter cylindrical section 116 enables the impedance of the cored-out section 114 to remain about equal to the impedance of the remainder of the coaxial cable 100, thus reducing internal reflections and resulting signal loss associated with inconsistent impedance.

In general, the impedance z of the coaxial cable 100 can be determined using Equation (1):

$$z = \left(\frac{138}{\sqrt{\varepsilon}}\right) * \log\left(\frac{\phi_{OUTER}}{\phi_{INNER}}\right) \quad (1)$$

where ∈ is the dielectric constant of the material between the inner and outer conductors 102 and 106, $ø_{OUTER}$ is the effective inside diameter of the corrugated outer conductor 106, and $ø_{DINNER}$ is the outside diameter of the inner conductor 102. However, once the insulating layer 104 is removed from the cored-out section 114 of the coaxial cable 100 and the metal mandrel 290 is inserted into the cored-out section 114, the metal mandrel 290 effectively becomes an extension of the metal outer conductor 106 in the cored-out section 114 of the coaxial cable 100.

In general, the impedance z of the example coaxial cable 100 should be maintained at 50 Ohms. Before termination, the impedance z of the coaxial cable is formed at 50 Ohms by forming the example coaxial cable 100 with the following characteristics:

$\epsilon$=1.100;

$ø_{OUTER}$=0.458 inches;

$ø_{INNER}$=0.191 inches; and z=50 Ohms.

During termination, however, the inside diameter of the cored-out section 114 of the outer conductor 106 $ø_{OUTER}$ of 0.458 inches is effectively replaced by the inside diameter of the mandrel 290 of 0.440 inches in order to maintain the impedance z of the cored-out section 114 of the coaxial cable 100 at 50 Ohms, with the following characteristics:

$\epsilon$=1.000;

$ø_{OUTER}$ (the inside diameter of the mandrel 290)=0.440 inches;

$ø_{INNER}$=0.191 inches; and z=50 Ohms.

Thus, the increase of the diameter of the outer conductor 106 enables the mandrel 290 to be formed from metal and effectively replace the inside diameter of the cored-out section 114 of the outer conductor 106 $ø_{OUTER}$. Further, the increase of the diameter of the outer conductor 106 also enables the mandrel 290 to alternatively be formed from a non-metal material having a dielectric constant that does not closely match the dielectric constant of the material from which the insulating layer 104 is formed.

As disclosed in FIGS. 3A and 3B, the particular increased diameter of the increased-diameter cylindrical section 116 correlates to the shape and type of material from which the mandrel 290 is formed. It is understood that any change to the shape and/or material of the mandrel 290 may require a corresponding change to the diameter of the increased-diameter cylindrical section 116.

As disclosed in FIGS. 3A and 3B, the increased diameter of the increased-diameter cylindrical section 116 also facilitates an increase in the thickness of the mandrel 290. In addition, as discussed above, the increased diameter of the increased-diameter cylindrical section 116 also enables the mandrel 290 to be formed from a relatively sturdy material such as metal. The relatively sturdy mandrel 290, in combination with the cylindrical configuration of the increased diameter cylindrical section 116, enables a relative increase in the amount of radial force that can be directed inward on the increased-diameter cylindrical section 116 without collapsing the increased-diameter cylindrical section 116 or the mandrel 290. Further, the cylindrical configuration of the increased-diameter cylindrical section 116 enables the inwardly-directed force to have primarily a radial component and have substantially no axial component, thus removing any dependency on a continuing axial force which can tend to decrease over time under extreme weather and temperature conditions. It is understood, however, that in addition to the primarily radial component directed to the increased-diameter cylindrical section 116, the example compression connector 200 may additionally include one or more structures that exert an inwardly-directed force having an axial component on another section or sections of the outer conductor 106.

This relative increase in the amount of force that can be directed inward on the increased-diameter cylindrical section 116 increases the security of the mechanical and electrical contacts between the mandrel 290, the increased-diameter cylindrical section 116, and the clamp 300. Further, the contracting configuration of the insulator 260 and the conductive pin 270 increases the security of the mechanical and electrical contacts between the conductive pin 270 and the inner conductor 102. Even in applications where these mechanical and electrical contacts between the compression connector 200 and the coaxial cable 100 are subject to stress due to high wind, precipitation, extreme temperature fluctuations, and vibration, the relative increase in the amount of force that can be directed inward on the increased diameter cylindrical section 116, combined with the contracting configuration of the insulator 260 and the conductive pin 270, tend to maintain these mechanical and electrical contacts with relatively small degradation over time. These mechanical and electrical contacts thus reduce, for example, micro arcing or corona discharge between surfaces, which reduces the PIM levels and associated creation of interfering RF signals that emanate from the example compression connector 200.

Figure 4A:
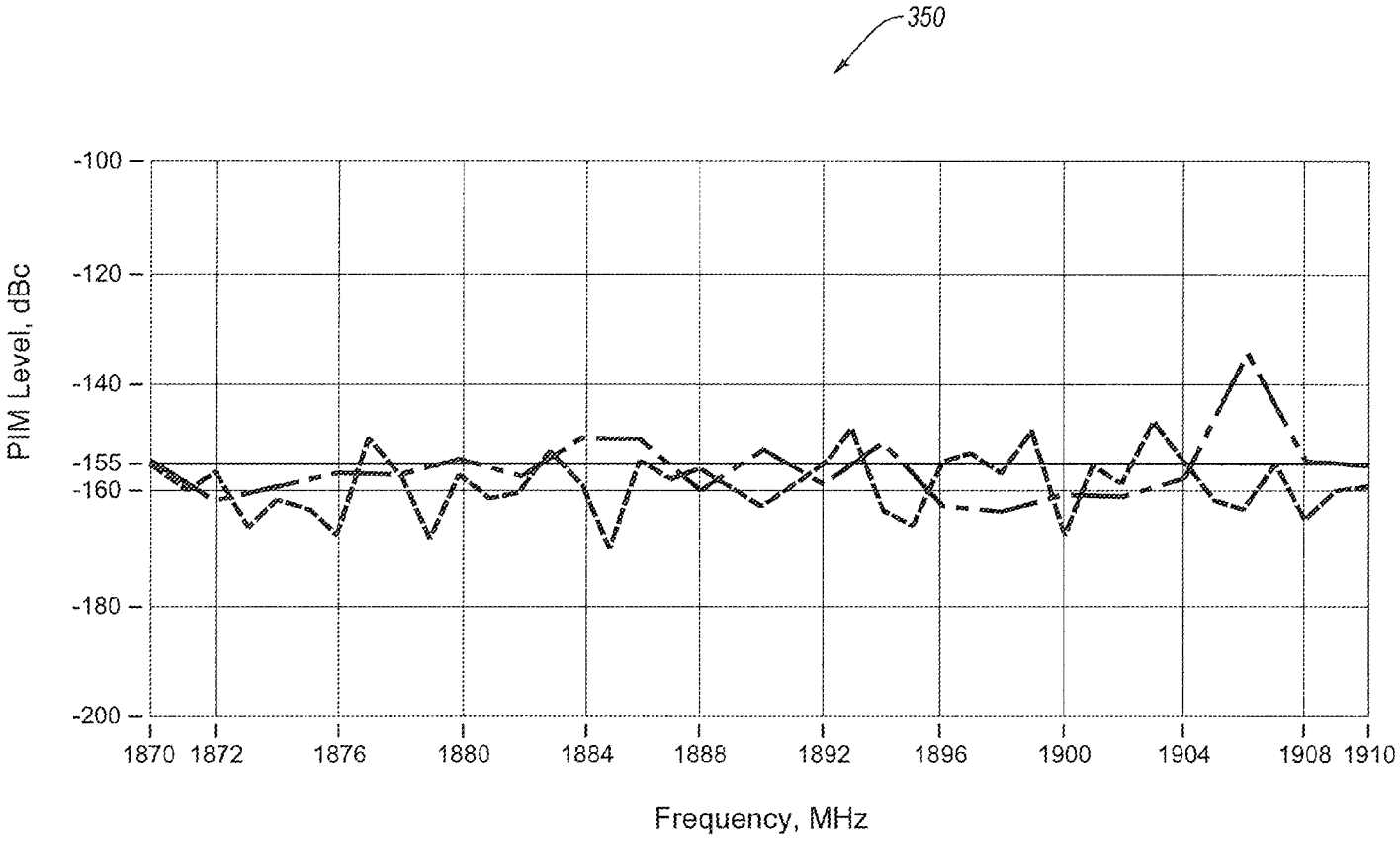
Fig. 4A (Prior Art)
FIG. 4A is a chart of passive intermodulation (PIM) in a prior art coaxial cable compression connector.

FIG. 4A discloses a chart 350 showing the results of PIM testing performed on a coaxial cable that was terminated using a prior art compression connector. The PIM testing that produced the results in the chart 350 was performed under dynamic conditions with impulses and vibrations applied to the prior art compression connector during the testing. As disclosed in the chart 350, the PIM levels of the prior art compression connector were measured on signals F1 and F2 to significantly vary across frequencies 1870-1910 MHz. In addition, the PIM levels of the prior art compression connector frequently exceeded a minimum acceptable industry standard of −155 dBc.

Figure 4B:
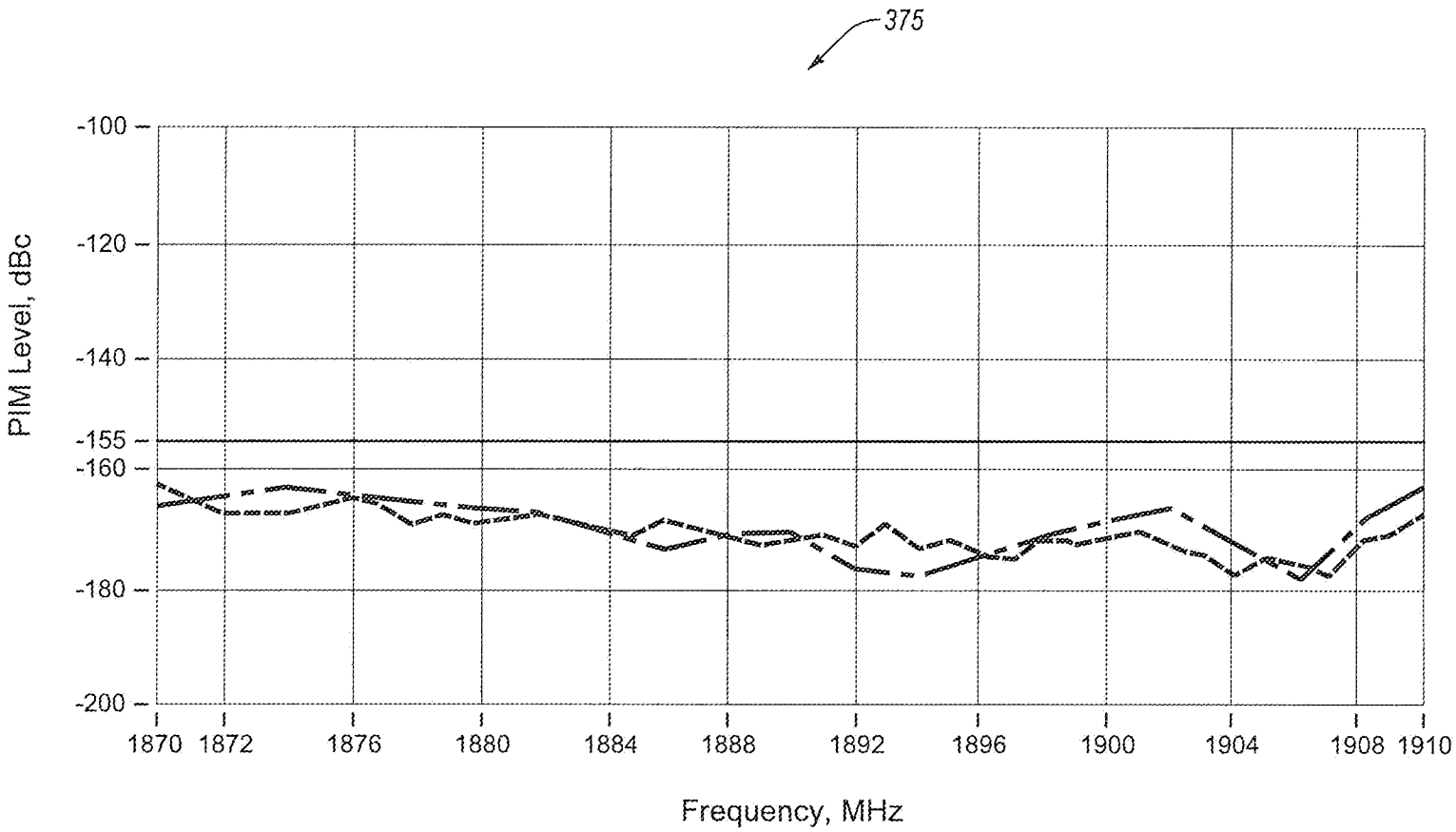
FIG. 4B is a chart of PIM in the example compression connector of FIG. 3B.

In contrast, FIG. 4B discloses a chart 375 showing the results of PIM testing performed on the coaxial cable 100 that was terminated using the example compression connector 200. The PIM testing that produced the results in the chart 375 was also performed under dynamic conditions with impulses and vibrations applied to the example compression connector 200 during the testing. As disclosed in the chart 375, the PIM levels of the example compression 200 were measured on signals F1 and F2 to vary significantly less across frequencies 1870-1910 MHz. Further, the PIM levels of the example compression connector 200 remained well below the minimum acceptable industry standard of −155 dBc. These superior PIM levels of the example compression connector 200 are due at least in part to the cylindrical configurations of the increased-diameter cylindrical section 116, the cylindrical outside surface 292 of the mandrel 290, and the cylindrical inside surface 302 of the clamp 300, as well as the contracting configuration of the insulator 260 and the conductive pin 270.

It is noted that although the PIM levels achieved using the prior art compression connector generally satisfy the minimum acceptable industry standard of −140 dBc (except at 1906 MHz for the signal F2) required in the 2G and 3G wireless industries for cellular communication towers. However, the PIM levels achieved using the prior art compression connector fall below the minimum acceptable industry standard of −155 dBc that is currently required in the 4G wireless industry for cellular communication towers. Compression connectors having PIM levels above this minimum acceptable standard of −155 dBc result in interfering RF signals that disrupt communication between sensitive receiver and transmitter equipment on the tower and lower-powered cellular devices in 4G systems. Advantageously, the relatively low PIM levels achieved using the example compression connector 200 surpass the minimum acceptable level of −155 dBc, thus reducing these interfering RF signals. Accordingly, the example field-installable compression connector 200 enables coaxial cable technicians to perform terminations of coaxial cable in the field that have sufficiently low levels of PIM to enable reliable 4G wireless communication. Advantageously, the example field installable compression connector 200 exhibits impedance matching and PIM characteristics that match or exceed the corresponding characteristics of less convenient factory-installed soldered or welded connectors on pre-fabricated jumper cables.

In addition, it is noted that a single design of the example compression connector 200 can be field-installed on various manufacturers' coaxial cables despite slight differences in the cable dimensions between manufacturers. For example, even though each manufacturer's ½" series corrugated coaxial cable has a slightly different sinusoidal period length, valley diameter, and peak diameter in the corrugated outer conductor, the preparation of these disparate corrugated outer conductors to have a substantially identical increased-diameter cylindrical section 116, as disclosed herein, enables each of these disparate cables to be terminated using a single compression connector 200. Therefore, the design of the example compression connector 200 avoids the hassle of having to employ a different connector design for each different manufacturer's corrugated coaxial cable.

Further, the design of the various components of the example compression connector 200 is simplified over prior art compression connectors. This simplified design enables these components to be manufactured and assembled into the example compression connector 200 more quickly and less expensively.

IV. Another Example Coaxial Cable and Example Compression Connector

Figure 5A:
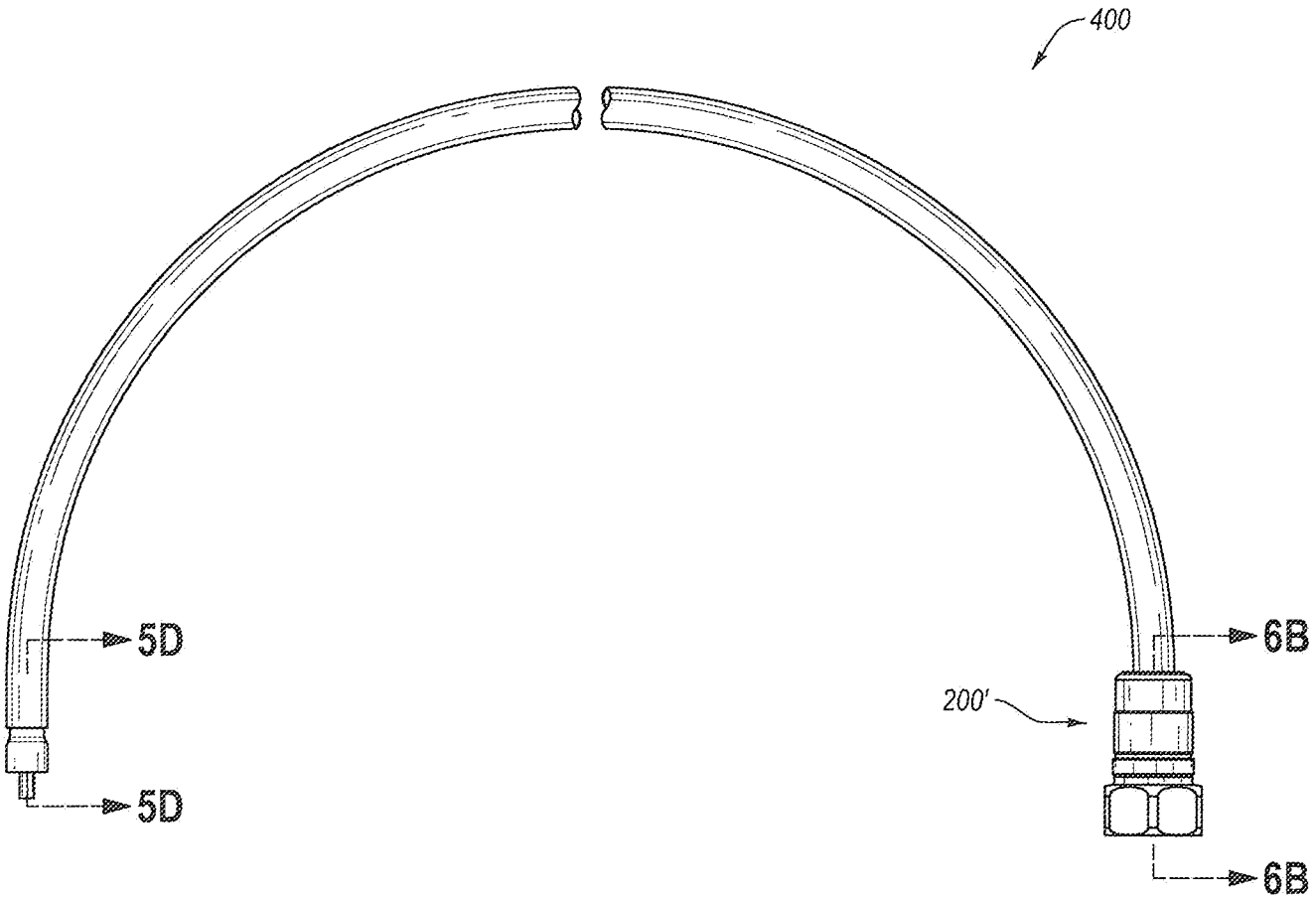
FIG. 5A is a perspective view of an example smooth-walled coaxial cable terminated on one end with another example compression connector.

With reference now to FIG. 5A, a second example coaxial cable 400 is disclosed. The example coaxial cable 400 also has 50 Ohms of impedance and is a ½" series smooth-walled coaxial cable. It is understood, however, that these cable characteristics are example characteristics only, and that the example compression connectors disclosed herein can also benefit coaxial cables with other impedance, dimension, and shape characteristics.

Also disclosed in FIG. 5A, the example coaxial cable 400 is also terminated on the right side of FIG. 5A with an example compression connector 200' that is identical to the example compression connector 200 in FIGS. 1A and 2A-3B, except that the example compression connector 200' has a different jacket seal, as shown and discussed below in connection with FIGS. 6A and 6B. It is understood, however, that the example coaxial cable 400 could be configured to be terminated with the example compression connector 200 instead of the example compression connector 200'. For example, where the outside diameter of the example coaxial cable 400 is the same or similar to the maximum outside diameter of the example coaxial cable 100, the jacket seal of the example compression connector 200 can function to seal both types of cable. Therefore, a single compression connector can be used to terminate both types of cable.

Figure 5B:
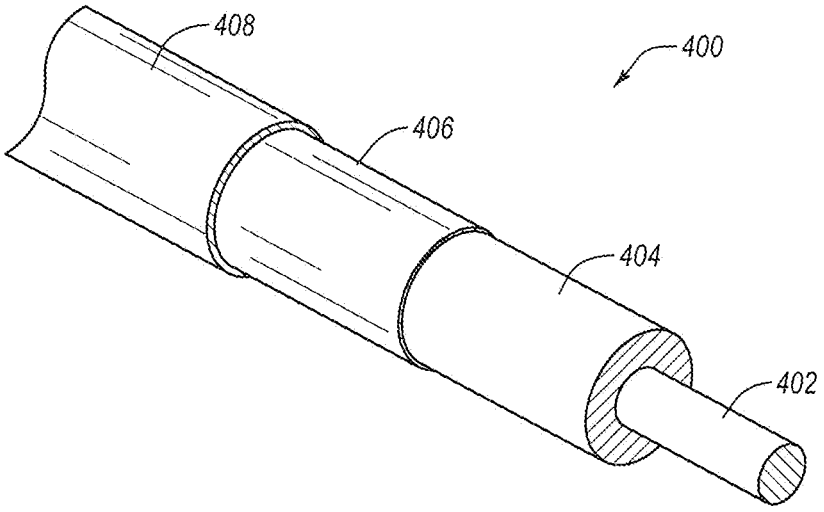
FIG. 5B is a perspective view of a portion of the example smooth-walled coaxial cable of FIG. 5A, the perspective view having portions of each layer of the coaxial cable cut away.

With reference now to FIG. 5B, the coaxial cable 400 generally comprises an inner conductor 402 surrounded by an insulating layer 404, a smooth-walled outer conductor 406 surrounding the insulating layer 404, and a jacket 408 surrounding the smooth-walled outer conductor 406. The inner conductor 402 and insulating layer 404 are identical in form and function to the inner conductor 102 and insulating layer 104, respectively, of the example coaxial cable 100. Further, the smooth-walled outer conductor 406 and jacket 408 are identical in form and function to the corrugated outer conductor 106 and jacket 108, respectively, of the example coaxial cable 400, except that the outer conductor 406 and jacket 408 are smooth walled instead of corrugated. The smooth-walled configuration of the outer conductor 406 enables the coaxial cable 400 to be generally more rigid than cables with corrugated outer conductors.

Figure 5C:
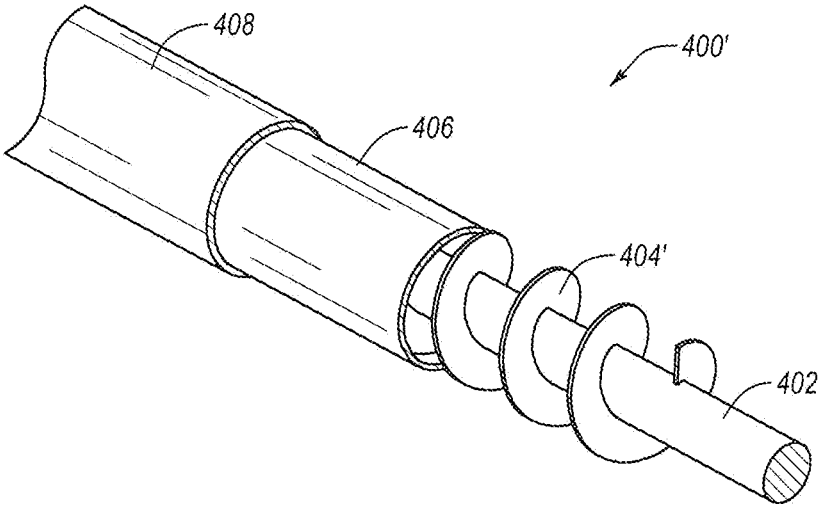
FIG. 5C is a perspective view of a portion of an alternative smooth-walled coaxial cable, the perspective view having portions of each layer of the alternative coaxial cable cut away.

As disclosed in FIG. 5C, an alternative coaxial cable 400' comprises an alternative insulating layer 404' composed of a spiral-shaped spacer that is identical in form and function to the alternative insulating layer 104' of FIG. 1C. Accordingly, the example compression connector 200' disclosed herein can similarly benefit the alternative coaxial cable 400'.

Figure 5D:
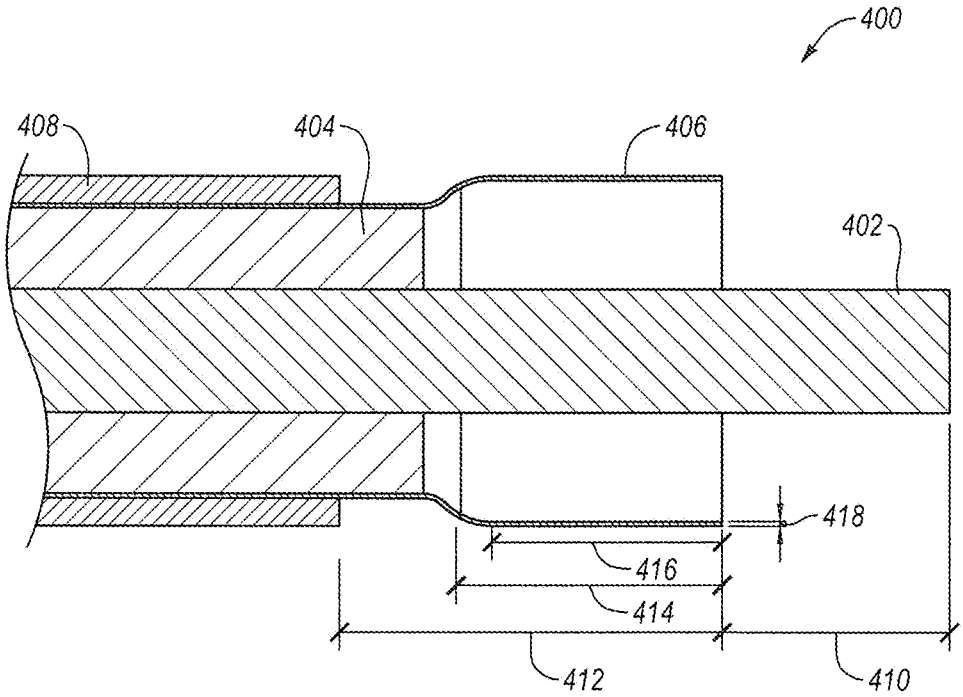
FIG. 5D is a cross-sectional side view of a terminal end of the example smooth-walled coaxial cable of FIG. 5A after having been prepared for termination with the example compression connector of FIG. 5A.
Figure 6A:
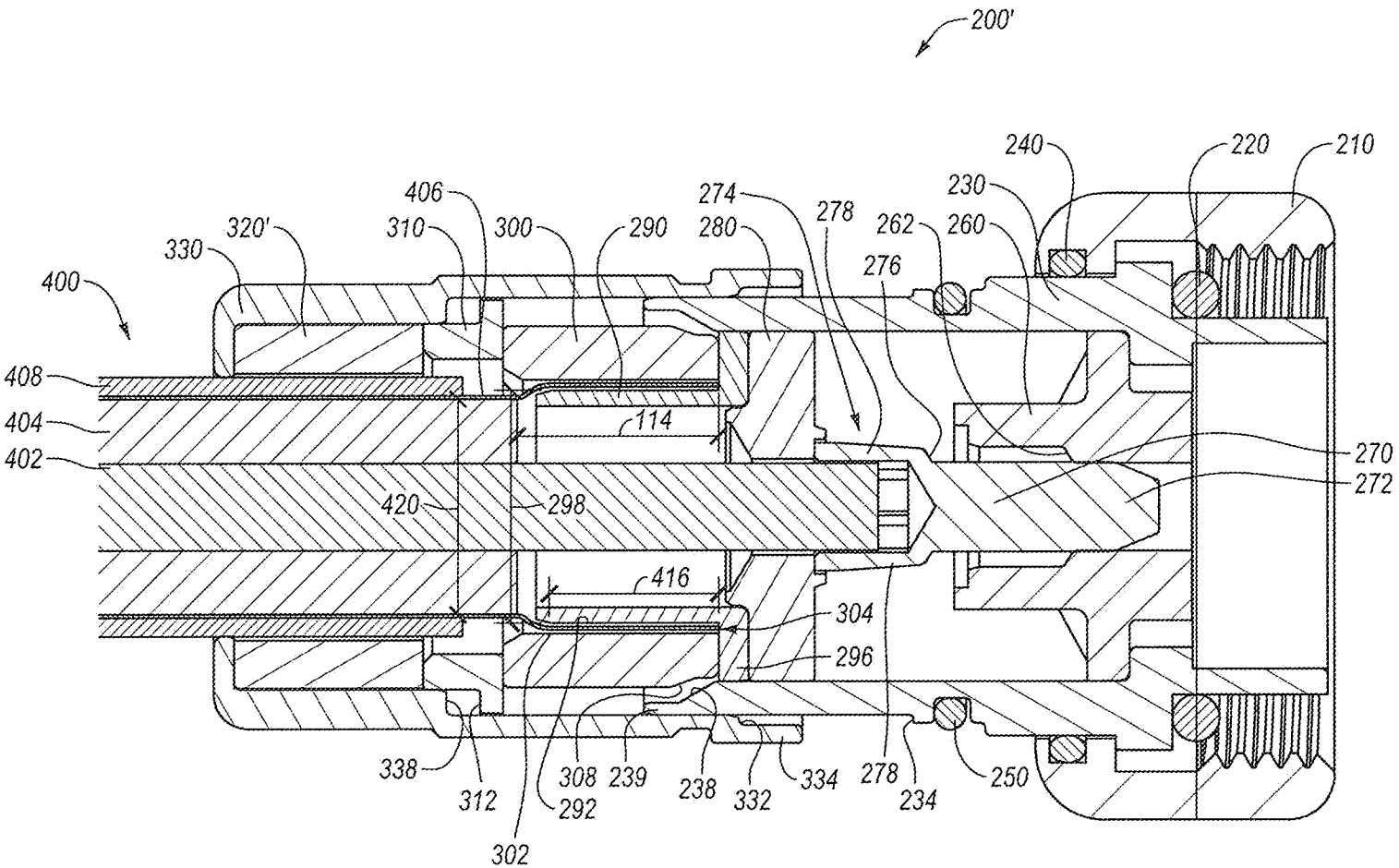
FIG. 6A is a cross-sectional side view of the terminal end of the example smooth-walled coaxial cable of FIG. 5D after having been inserted into the example compression connector of FIG. 5A, with the example compression connector being in an open position.
Figure 6B:
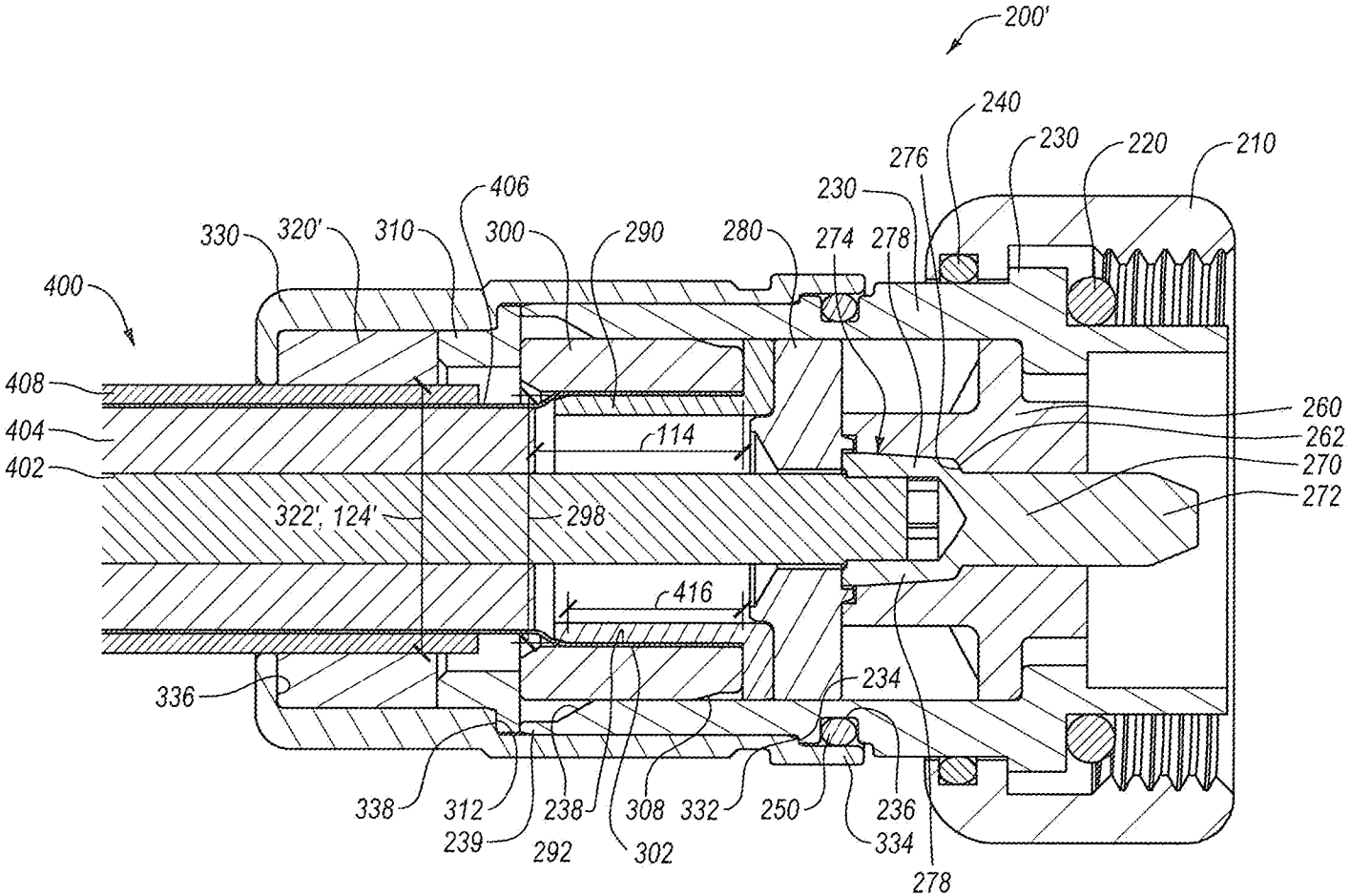
FIG. 6B is a cross-sectional side view of the terminal end of the example smooth-walled coaxial cable of FIG. 5D after having been inserted into the example compression connector of FIG. 6A, with the example compression connector being in an engaged position.

With reference to FIG. 5D, a terminal end of the coaxial cable 400 is disclosed after having been prepared for termination with the example compression connector 200', disclosed in FIGS. 5A and 6A-6B. As disclosed in FIG. 5D, the terminal end of the coaxial cable 400 comprises a first section 410, a second section 412, a cored-out section 414, and an increased-diameter cylindrical section 416. The jacket 408, smooth-walled outer conductor 406, and insulating layer 404 have been stripped away from the first section 410. The jacket 408 has been stripped away from the second section 412. The insulating layer 404 has been cored out from the cored out section 414. The diameter of a portion of the smooth-walled outer conductor 406 that surrounds the cored-out section 414 has been increased so as to create the increased-diameter cylindrical section 416 of the outer conductor 406. This increasing of the diameter of the smooth-walled outer conductor 406 can be accomplished as discussed above in connection with the increasing of the diameter of the corrugated outer conductor 106 in FIG. 1D.

As disclosed in FIG. 5D, the increased-diameter cylindrical section 416 of the smooth-walled outer conductor 406 has a substantially uniform diameter throughout the length of the section 416. The length of the increased-diameter cylindrical section 416 should be sufficient to allow a force to be directed inward on the increased-diameter cylindrical section 416, once the smooth-walled coaxial cable 400 is terminated with the example compression connector 200', with the inwardly directed force having primarily a radial component and having substantially no axial component.

As disclosed in FIG. 5D, the length of the increased-diameter cylindrical section 416 is thirty-three times the thickness 418 of the outer conductor 406. It is understood, however, that the length of the increased-diameter cylindrical section 416 could be any length from two times the thickness 418 of the outer conductor 406 upward. It is further understood that the tools and/or processes that fashion the increased-diameter cylindrical section 416 may further create increased diameter portions of the smooth-walled outer conductor 406 that are not cylindrical. The preparation of the terminal section of the example smooth-walled coaxial cable 400 disclosed in FIG. 5D can be accomplished as discussed above in connection with the example corrugated coaxial cable 100.

V. Cable Termination Using the Example Compression Connector

With reference now to FIGS. 6A and 6B, aspects of the operation of the example compression connector 200' are disclosed. In particular, FIG. 6A discloses the example compression connector 200' in an initial open position, while FIG. 6B discloses the example compression connector 200' after having been moved into an engaged position.

As disclosed in FIG. 6A, the terminal end of the smooth-walled coaxial cable 400 of FIG. 5D can be inserted into the example compression connector 200' through the compression sleeve 330. Once inserted, the increased-diameter cylindrical section 416 of the outer conductor 406 is received into the cylindrical gap 304 defined between the cylindrical outside surface 292 of the mandrel 290 and the cylindrical inside surface 302 of the clamp 300. Also, once inserted, the jacket seal 320' surrounds the jacket 408 of the smooth-walled coaxial cable 400, and the inner conductor 402 is received into the collet portion 274 of the conductive pin 270 such that the conductive pin 270 is mechanically and electrically contacting the inner conductor 402. As disclosed in FIG. 6A, the diameter 298 of the cylindrical outside surface 292 of the mandrel 290 is greater than the smallest diameter 420 of the smooth-walled outer conductor 406, which is the inside diameter of the outer conductor 406. Further, the jacket seal 320' has an inside diameter 322' that is less than the sum of the diameter 298 of the cylindrical outside surface 292 of the mandrel 290 plus two times the thickness of the jacket 408.

FIG. 6B discloses the example compression connector 200' after having been moved into an engaged position. The example compression connector 200' is moved into an engaged position in an identical fashion as discussed above in connection with the example compression connector 200 in FIGS. 3A and 3B. As the compression connector 200' is moved into the engaged position, the clamp 300 is radially compressed by the axial force exerted on the compression sleeve 330 and the cylindrical inside surface 302 of the clamp 300 is clamped around the increased diameter cylindrical section 416 of the outer conductor 406 so as to radially compress the increased-diameter cylindrical section 416 between the cylindrical inside surface 302 of the clamp 300 and the cylindrical outside surface 292 of the mandrel 290.

In addition, as the compression connector 200' is moved into the engaged position, the axial force of the shoulder 336 of the compression sleeve 330 combined with the opposite axial force of the clamp ring 310 axially compresses the jacket seal 320' causing the jacket seal 320' to become shorter in length and thicker in width. The thickened width of the jacket seal 320' causes the jacket seal 320' to press tightly against the jacket 408 of the smooth-walled coaxial cable 400, thus sealing the compression sleeve 330 to the jacket 408 of the smooth-walled coaxial cable 400. Once sealed, the narrowest inside diameter 322' of the jacket seal 320', which is equal to the outside diameter 124' of the jacket 408, is less than the sum of the diameter 298 of the cylindrical outside surface 292 of the mandrel 290 plus two times the thickness of the jacket 408.

As noted above in connection with the example compression connector 200, the termination of the smooth-walled coaxial cable 400 using the example compression connector 200' enables the impedance of the cored-out section 414 to remain about equal to the impedance of the remainder of the coaxial cable 400, thus reducing internal reflections and resulting signal loss associated with inconsistent impedance. Further, the termination of the smooth-walled coaxial cable 400 using the example compression connector 200' enables improved mechanical and electrical contacts between the mandrel 290, the increased-diameter cylindrical section 416, and the clamp 290, as well as between the inner conductor 402 and the conductive pin 270, which reduces the PIM levels and associated creation of interfering RF signals that emanate from the example compression connector 200'.

VI. Another Example Compression Connector

Figure 7A:
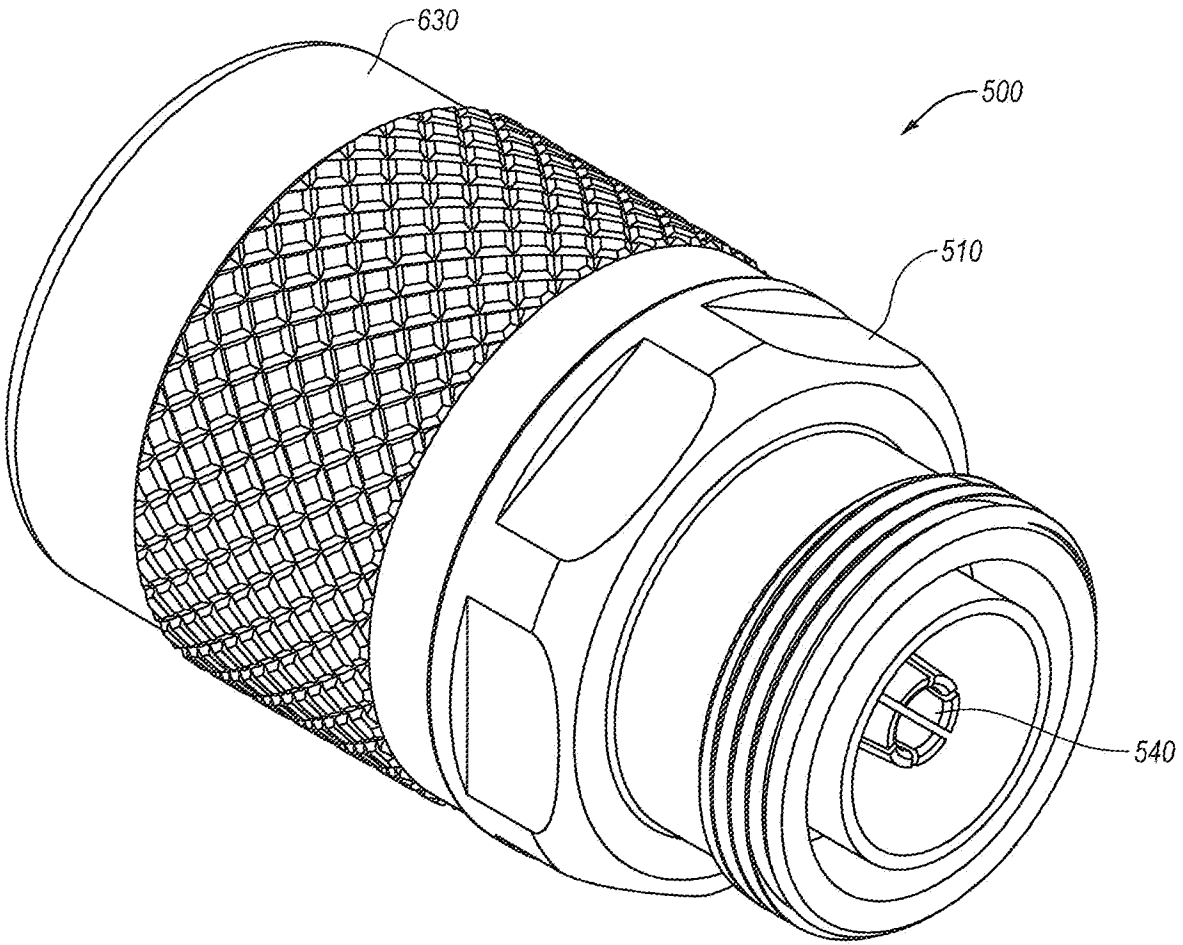
FIG. 7A is a perspective view of another example compression connector.
Figure 7B:
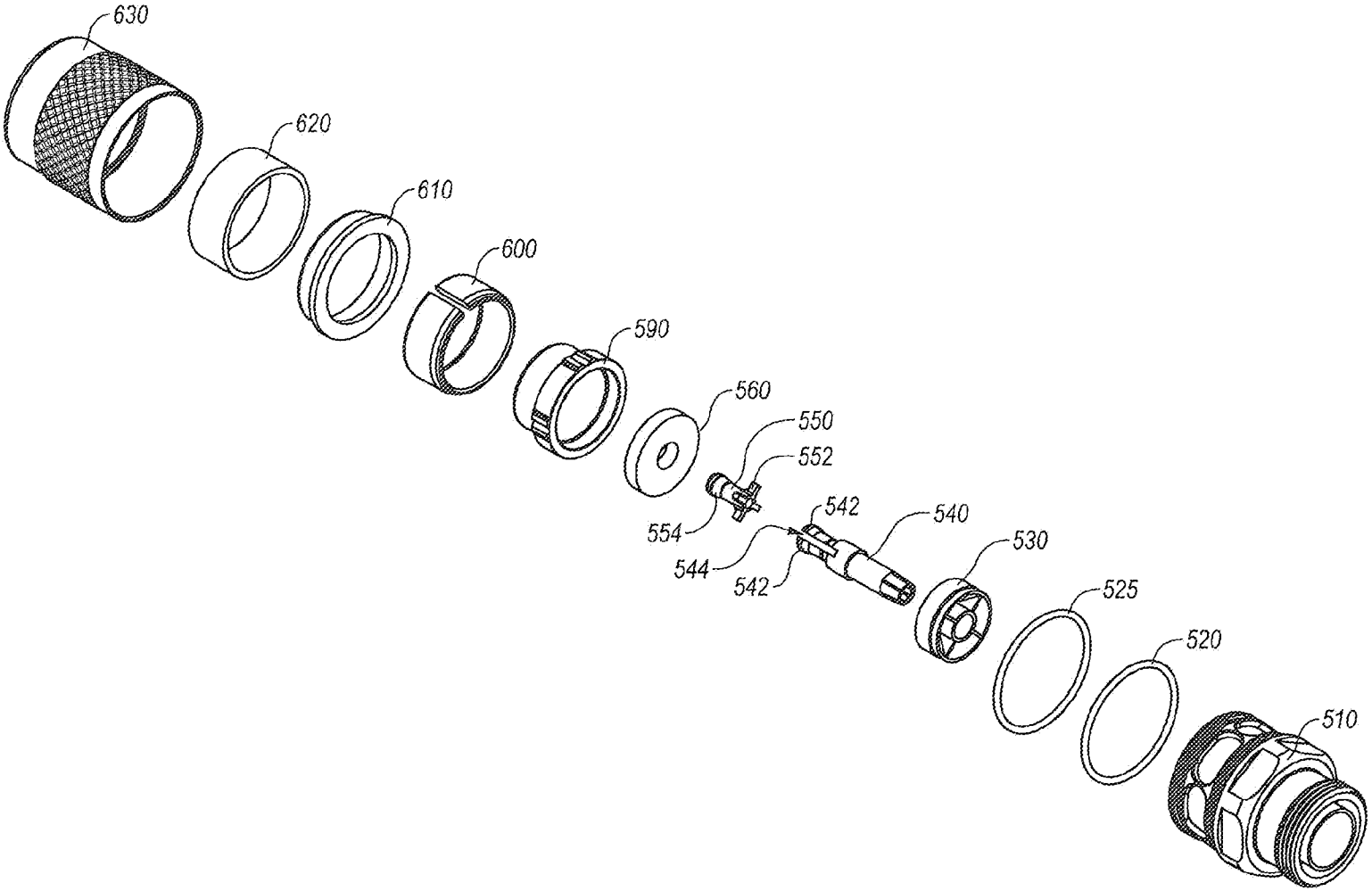
FIG. 7B is an exploded view of the example compression connector of FIG. 7A.

With reference now to FIGS. 7A and 7B, another example compression connector 500 is disclosed. The example compression connector 500 is configured to terminate either smooth-walled or corrugated 50 Ohm ⅞" series coaxial cable. Further, although the example compression connector 500 is disclosed in FIG. 7A as a female compression connector, it is understood that the compression connector 500 can instead be configured as a male compression connector (not shown).

As disclosed in FIGS. 7A and 7B, the example compression connector 500 comprises a connector body 510, a first o-ring seal 520, a second o-ring seal 525, a first insulator 530, a conductive pin 540, a guide 550, a second insulator 560, a mandrel 590, a clamp 600, a clamp ring 610, a jacket seal 620, and a compression sleeve 630. The connector body 510, first o-ring seal 520, second o-ring seal 525 mandrel 590, clamp 600, clamp ring 610, jacket seal 620, and compression sleeve 630 function similarly to the connector body 230, second o-ring seal, third o-ring seal 250, mandrel 290, clamp 300, clamp ring 310, jacket seal 320, and compression sleeve 330, respectively. The first insulator 530, conductive pin 540, guide 550, and second insulator 560 function similarly to the insulator 13, pin 14, guide 15, and insulator 16 disclosed in U.S. Pat. No. 7,527,512, titled "CABLE CONNECTOR EXPANDING CONTACT," which issued May 5, 2009 and is incorporated herein by reference in its entirety.

As disclosed in FIG. 7B, the conductive pin 540 comprises a plurality of fingers 542 separated by a plurality of slots 544. The guide 550 comprises a plurality of corresponding tabs 552 that correspond to the plurality of slots 544. Each finger 542 comprises a ramped portion 546 (see FIG. 7C) on an underside of the finger 542 which is configured to interact with a ramped portion 554 of the guide 550. The second insulator 560 is press fit into a groove 592 formed in the mandrel 590.

Figure 7C:
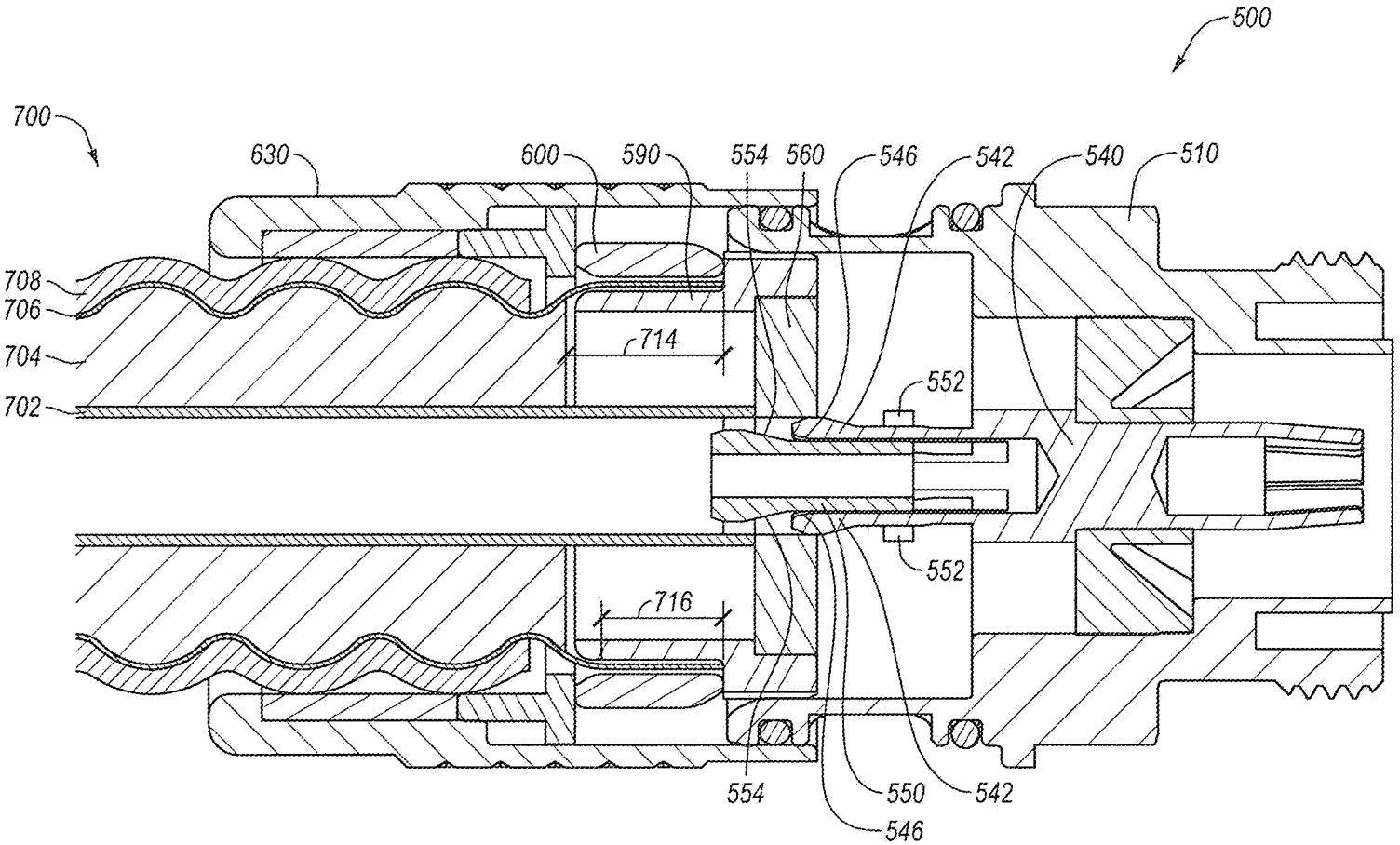
FIG. 7C is a cross-sectional side view of the example compression connector of FIG. 7A after having a terminal end of another example corrugated coaxial cable inserted into the example compression connector, with the example compression connector being in an open position.
Figure 7D:
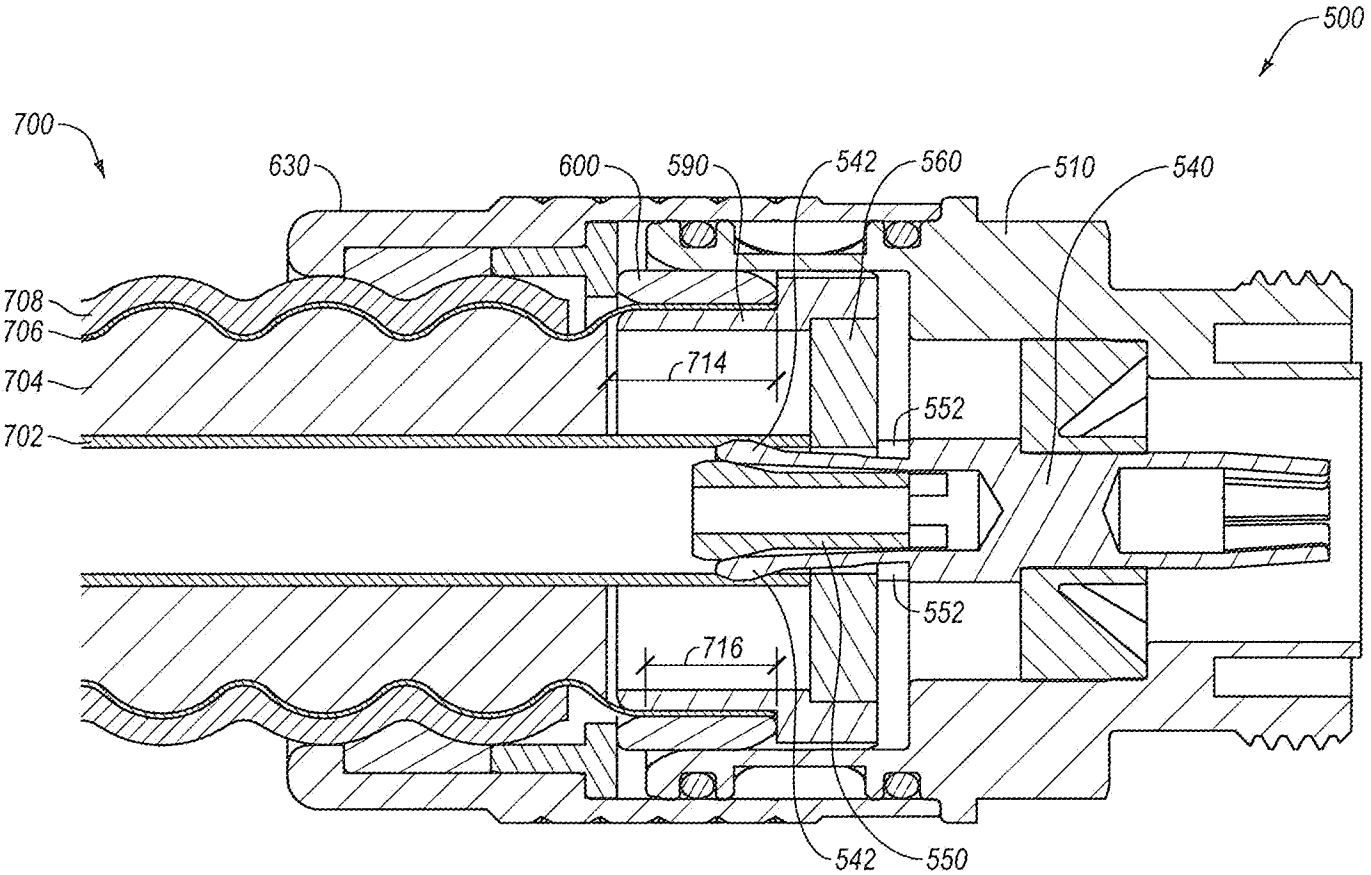
FIG. 7D is a cross-sectional side view of the example compression connector of FIG. 7A after having the terminal end of the example corrugated coaxial cable of FIG. 7C inserted into the example compression connector, with the example compression connector being in an engaged position.

With reference to FIGS. 7C and 7D, additional aspects of the example compression connector 500 are disclosed. FIG. 7C discloses the example compression connector in an open position. FIG. 7D discloses the example compression connector 500 in an engaged position.

As disclosed in FIG. 7C, a terminal end of an example corrugated coaxial cable 700 can be inserted into the example compression connector 500 through the compression sleeve 630. It is noted that the example compression connector 500 can also be employed in connection with a smooth-walled coaxial cable (not shown). Once inserted, portions of the guide 550 and the conductive pin 540 can slide easily into the hollow inner conductor 702 of the coaxial cable 700.

As disclosed in FIGS. 7C and 7D, as the compression connector 500 is moved into the engaged position, the conductive pin 540 is forced into the inner conductor 702 beyond the ramped portions 554 of the guide 550 due to the interaction of the tabs 552 and the second insulator 560, which causes the conductive pin 540 to slide with respect to the guide 550. This sliding action forces the fingers 542 to radially expand due to the ramped portions 546 interacting with the ramped portion 554. This radial expansion of the conductive pin 540 results in an increased contact force between the conductive pin 540 and the inner conductor 702, and can also result in some deformation of the inner conductor 702, the guide 550, and/or the fingers 542. This expanding configuration increases the reliability of the mechanical and electrical contact between the conductive pin 540 and the inner conductor 702.

As noted above in connection with the example compression connectors 200 and 200', the termination of the corrugated coaxial cable 700 using the example compression connector 500 enables the impedance of the cored-out section 714 of the cable 700 to remain about equal to the impedance of the remainder of the cable 700, thus reducing internal reflections and resulting signal loss associated with inconsistent impedance. Further, the termination of the corrugated coaxial cable 700 using the example compression connector 500 enables improved mechanical and electrical contacts between the mandrel 590, the increased-diameter cylindrical section 716, and the clamp 600, as well as between the inner conductor 702 and the conductive pin 540, which reduces the PIM levels and associated creation of interfering RF signals that emanate from the example compression connector 500.

The example embodiments disclosed herein may be embodied in other specific forms. The example embodiments disclosed herein are to be considered in all respects only as illustrative and not restrictive.

What is claimed is:

1. A coaxial cable connector comprising:

a coupler comprising a first coupler end and a second coupler end;

a component configured to extend along an axis and at least partially receive an inner conductor of a cable end of a coaxial cable, having an insulator surrounding the inner conductor, and a corrugated outer conductor surrounding the insulator, the corrugated outer conductor including an end section having an outer surface region and an inner surface region located opposite of the outer surface region, the inner surface region defining a first space, the component comprising a support surface configured to be at least an inner conductor engager defining a second space configured to at least partially receive the inner conductor, the inner conductor engager comprising a plurality of fingers surrounding the second space;

an outer conductor engager including a first portion extending along a first direction parallel to the axis and a second portion extending along a second direction that is not parallel to the axis, the first portion being configured to at least partially receive the end section as the end section is non-rotatably slid along the axis relative to the outer conductor engager; and a compressor configured to at least partially receive the component, the compressor having a first compressor end and a second compressor end, the first compressor end configured to be located closer to the coupler than the second compressor end, wherein the coupler and the compressor are configured to be arranged so that there is a first distance between the first coupler end and the second compressor end, wherein the coaxial cable connector is configured to enable the compressor to axially move along the axis relative to the coupler as a result of at least one axial installation force acting along the axis, and wherein the coaxial cable connector is configured so that:

the second space at least partially receives the inner conductor resulting from the axial movement;

the fingers engage the inner conductor resulting from the axial movement;

at least part of the end section is compressed between the outer conductor engager and the support surface resulting from the axial movement, wherein the support surface abuts the inner surface region when at least one of the portions of the outer conductor engager abuts the outer surface region;

the compression applies a force to the outer conductor resulting from the axial movement, wherein at least part of the force acts in a radial direction, and also resulting from the axial movement, the coupler and the compressor move closer together along the axis so that there is a second distance between the first coupler end and the second compressor end, wherein the second distance is less than the first distance.

2. The coaxial cable connector of claim 1, wherein the coupler comprises a threaded nut.

3. The coaxial cable connector of claim 1, wherein the fingers are configured to flex.

4. The coaxial cable connector of claim 1, wherein the component comprises a mandrel.

5. The coaxial cable connector of claim 1, wherein the compressor has a substantially tubular shape.

6. The coaxial cable connector of claim 1, wherein the compressor comprises a compression sleeve.

7. The coaxial cable connector of claim 1, wherein the component comprises a tubular shape.

8. The coaxial cable connector of claim 1, wherein the coaxial cable connector comprises a body configured to be rotatably coupled to the second coupler end, the body being extendable along the axis, the body configured to at least partially receive the inner conductor, the body also configured to at least partially receive the component.

9. The coaxial cable connector of claim 1, wherein the support surface comprises an inwardly tapered outside surface.

10. The coaxial cable connector of claim 1, wherein at least one of the support surface and one of the portions of the outer conductor engager extends in a first plane that is parallel with a second plane through which the end section extends.

11. The coaxial cable connector of claim 1, wherein the corrugated outer conductor comprises a plurality of peaks and a plurality of valleys, the compressed part extending at least partially from one of the peaks or valleys, the compressed part extending to a terminal edge of the end section.

12. The coaxial cable connector of claim 1, wherein the coaxial cable connector is configured so that, as a result of the axial movement, the compressed part is clamped between the support surface and one of the portions of the outer conductor engager so as to eliminate a conduction disruption gap between the support surface and the inner surface region of the corrugated outer conductor.

13. The coaxial cable connector of claim 1, wherein the coaxial cable connector is configured so that, as a result of the axial movement, the support surface abuts the inner surface region when the first portion of the outer conductor engager abuts the outer surface region.

14. The coaxial cable connector of claim 1, wherein the coaxial cable connector is configured so that, as a result of the axial movement, the corrugated outer conductor is prevented from being disengaged from the outer conductor engager without application of a disengagement force that is selected from the group consisting of: (a) a disengagement force that, when applied to the coaxial cable connector, would exceed a strength limit of the coaxial cable; and (b) a disengagement force that, when applied to the coaxial cable connector, would cause the coaxial cable connector to become unassembled from an assembled, compressed state, and wherein a process other than a screwing process would be required to return the coaxial cable connector to the assembled, compressed state.

15. The coaxial cable connector of claim 1, wherein the corrugated outer conductor has a corrugation selected from the group consisting of an annular corrugation and a helical corrugation.

16. The coaxial cable connector of claim 1, wherein the outer conductor engager comprises a clamp.

17. The coaxial cable connector of claim 16, wherein the corrugated outer conductor comprises a maximum diameter, and the first portion of the outer conductor engager has a minimum diameter that is no less than the maximum diameter.

18. The coaxial cable connector of claim 1, wherein the coaxial cable comprises a jacket surrounding the corrugated outer conductor, the coaxial cable connector comprises a jacket seal configured to engage the jacket, and wherein as a result of the axial movement, the jacket seal is engaged with the jacket.

19. The coaxial cable connector of claim 18, wherein the coaxial cable connector comprises a compression member configured to compress the jacket seal.

20. The coaxial cable connector of claim 18, wherein a portion of the coaxial cable connector is configured to receive the jacket and to define, as a result of the axial movement, a third space between the jacket and the portion, and wherein the jacket seal is at least partially positioned within the third space.

21. A coaxial cable connector comprising:

a coupler;

a component extendable along an axis, the component configured to receive an inner conductor of an end of a coaxial cable, the coaxial cable comprising a corrugated outer conductor surrounding the inner conductor, the corrugated outer conductor comprising an end section, the end section defining a first space, the component comprising a support surface configured to be at least partially inserted into the first space;

an inner conductor engager defining a second space configured to at least partially receive the inner conductor;

an outer conductor engager configured to at least partially surround the corrugated outer conductor, the outer conductor engager comprising a plurality of portions, at least one of the portions extending parallel to the axis, the at least one portion configured to at least partially receive the end section when the end section non-rotatably slides along the axis relative to the outer conductor engager; and a compressor configured to be coupled to the component;

wherein the coaxial cable connector is configured to have a first length when the coaxial cable connector is in an uninstalled state, wherein the coaxial cable connector is configured to enable the compressor to axially move along the axis relative to the coupler as a result of at least one axial installation force acting along the axis, and wherein the coaxial cable connector is configured so that:

the second space at least partially receives the inner conductor resulting from the axial movement;

at least part of the end section is clamped between the support surface and one of the portions of the outer conductor engager resulting from the axial movement;

the clamping of the at least part of the end section applies an engagement force to the at least part resulting from the axial movement, wherein the engagement force acts at least partially in a radial direction; and also resulting from the axial movement, the coaxial cable connector has a second length when the coaxial cable connector is in an installed state, wherein the second length is less than the first length.

22. The coaxial cable connector of claim 21, wherein the coupler comprises a threaded nut.

23. The coaxial cable connector of claim 21, wherein the inner conductor engager comprises a plurality of flexible fingers.

24. The coaxial cable connector of claim 21, wherein the outer conductor engager comprises a clamp.

25. The coaxial cable connector of claim 21, wherein the component comprises a mandrel.

26. The coaxial cable connector of claim 21, wherein the coaxial cable connector comprises a body configured to be rotatably coupled to the coupler to extend along the axis, to at least partially receive the inner conductor, and to at least partially receive the component.

27. The coaxial cable connector of claim 21, wherein the support surface comprises an inwardly tapered outside surface.

28. The coaxial cable connector of claim 21, wherein at least one of the support surface and one of the portions of the outer conductor engager extends in a first plane that is parallel with a second plane through which the clamped part of the end section extends.

29. The coaxial cable connector of claim 21, wherein the corrugated outer conductor comprises a plurality of peaks and a plurality of valleys, wherein the clamped part extends at least partially from one of the peaks or valleys and extends to a terminal edge of the end section.

30. The coaxial cable connector of claim 21, wherein the coaxial cable connector is configured so that, as a result of the axial movement, the clamping eliminates a conduction disruption gap between the support surface and the clamped part of the end section of the outer conductor.

31. The coaxial cable connector of claim 21, wherein the end section comprises an outer surface region and an inner surface region opposite of the outer surface region, wherein the inner surface region defines the first space, wherein the coaxial cable connector is configured so that, as a result of the axial movement, the support surface abuts the inner surface region when the at least one portion of the outer conductor engager abuts the outer surface region.

32. The coaxial cable connector of claim 21, wherein the coaxial cable connector is configured so that, as a result of the axial movement, the corrugated outer conductor is prevented from being disengaged from the outer conductor engager without application of a disengagement force that is selected from the group consisting of: (a) a disengagement force that, when applied to the coaxial cable connector, would exceed a strength limit of the coaxial cable; and (b) a disengagement force that, when applied to the coaxial cable connector, would cause the coaxial cable connector to become unassembled from an assembled, compressed state, and wherein a process other than a screwing process would be required to return the coaxial cable connector to the assembled, compressed state.

33. The coaxial cable connector of claim 21, wherein the corrugated outer conductor has a corrugation selected from the group consisting of an annular corrugation and a helical corrugation.

34. The coaxial cable connector of claim 21, wherein the coaxial cable comprises a jacket surrounding the outer conductor, wherein the coaxial cable connector comprises a jacket seal configured to engage the jacket, and wherein as a result of the axial movement, the jacket seal is engaged with the jacket.

35. The coaxial cable connector of claim 34, wherein the coaxial cable connector comprises a compression member configured to compress the jacket seal.

36. The coaxial cable connector of claim 34, wherein a portion of the coaxial cable connector is configured to receive the jacket, wherein, as a result of the axial movement, the portion defines a third space between the jacket and the portion, and wherein the jacket seal is at least partially positioned within the third space.

37. The coaxial cable connector of claim 21, wherein the corrugated outer conductor has a maximum diameter, and wherein the at least one portion of the outer conductor engager comprises a minimum diameter that is greater than the maximum diameter of the corrugated outer conductor.

38. The coaxial cable connector of claim 37, wherein the component comprises a mandrel.

39. The coaxial cable connector of claim 21, wherein the compressor has a substantially tubular shape.

40. The coaxial cable connector of claim 39, wherein the compressor comprises a compression sleeve.

41. A connector for a coaxial cable having an inner conductor and a corrugated outer conductor surrounding the inner conductor, the corrugated outer conductor including an end section having an outer surface region and an inner surface region located opposite from the outer surface region, and the inner surface region defining a first space, the connector comprising:

a coupler configured to extend along an axis;

a component configured to extend along the axis and to at least partially receive the inner conductor, the component having a tubular shape and a support surface configured to be at least partially inserted into the first space;

an inner conductor engager defining a second space configured to at least partially receive the inner conductor;

an outer conductor engager configured to at least partially receive the corrugated outer conductor and non-rotatably slide along the axis relative to an end section of a corrugated outer conductor of a coaxial cable, the outer conductor engager comprising a plurality of inner surfaces, at least one of the inner surfaces configured to extend parallel to the axis and to at least partially receive the end section when the outer conduct engager non-rotatably slides along the axis relative to the end section of the corrugated outer conductor; and a sleeve configured to at least partially receive the component;

wherein the connector is configured to allow the sleeve to axially move along the axis from a first position, where the second space receives part of the inner conductor, where the inner conductor engager engages the received part of the inner conductor, and where the outer conductor engager receives at least part of the end section, to a second position, where the outer conductor engager applies a radial force to the received part of the end section, where the received part of the end section is compressed between the outer conductor engager and the support surface, and where the support surface abuts the inner surface region of the received part of the end section when the at least one inner surface of the outer conductor engager abuts the outer surface region of the end section; and wherein a length of the connector is reduced when the connector moves from the first position to the second position.

42. The connector of claim 41, wherein the coupler comprises a threaded nut.

43. The connector of claim 41, wherein the inner conductor engager comprises a plurality of fingers.

44. The connector of claim 41, wherein the outer conductor engager comprises a clamp.

45. The connector of claim 41, wherein the corrugated outer conductor comprises a maximum diameter, and the at least one inner surface of the outer conductor engager has a minimum diameter that is no less than the maximum diameter.

46. The connector of claim 41, wherein the component comprises a mandrel.

47. The connector of claim 41, wherein the sleeve comprises a compression sleeve.

48. The connector of claim 41, comprising a body configured to be rotatably coupled to the coupler, to extend along the axis, to at least partially receive the inner conductor, and to at least partially receive the component.

49. The connector of claim 41, wherein the support surface comprises an inwardly tapered outside surface.

50. The connector of claim 41, wherein at least one of the support surface and the at least one inner surface of the outer conductor engager extends in a first plane that is parallel with a second plane through which the received part of the end section extends.

51. The connector of claim 41, wherein the corrugated outer conductor comprises a plurality of peaks and a plurality of valleys, wherein the received part of the end section extends at least partially from one of the peaks or valleys, and wherein the received part of the end section extends to a terminal edge of the end section.

52. The connector of claim 41, wherein the connector is configured to clamp the received part of the end section between the support surface and the at least one inner surface of the outer conductor engager when the connector moves from the first position to the second position so as to prevent a gap from disrupting conduction between the support surface and the inner surface region of the corrugated outer conductor.

53. The connector of claim 41, wherein the connector is configured to be non-rotatably moved from a uncompressed state to a compressed state such that the connector cannot be rotatably returned to the uncompressed state.

54. The connector of claim 41, wherein the connector is configured to be non-rotatably moved from a uncompressed state to a compressed state such that the connector cannot be rotatably returned to the uncompressed state during normal operating conditions of the connector and without applying excessive force to the connector.

55. The connector of claim 41, wherein the connector is configured to be non-rotatably moved from an assembled, uncompressed state to an assembled, compressed state such that the connector cannot be returned to the assembled, uncompressed state by unscrewing the connector.

56. The connector of claim 41, wherein the corrugated outer conductor has a corrugation selected from the group consisting of an annular corrugation and a helical corrugation.

57. The connector of claim 41, wherein the connector is configured to be non-twistably moved from a uncompressed state to a compressed state such that the connector cannot be twistably returned to the uncompressed state during normal operating conditions of the connector and without applying excessive force to the connector.

58. The connector of claim 41, wherein the connector is configured to be non-twistably moved from an assembled, uncompressed state to an assembled, compressed state such that the connector cannot be returned to the assembled, uncompressed state by untwisting the connector.

59. The connector of claim 41, wherein the connector is configured to prevent the corrugated outer conductor from being disengaged from the outer conductor engager without applying a disengagement force when the connector moves from the first position to the second position.

60. The connector of claim 59, wherein the disengagement force comprises a force that would exceed a strength limit of the coaxial cable when applied to the connector.

61. The connector of claim 59, wherein the disengagement force comprises a force that would cause the connector to become unassembled from an assembled, compressed state when applied to the connector.

62. The connector of claim 41, wherein the coaxial cable comprises a jacket surrounding the corrugated outer conductor, wherein the connector comprises a jacket seal configured to engage the jacket, and wherein the jacket seal is configured to engage the jacket when the connector moves from the first position to the second position.

63. The connector of claim 62, wherein the connector comprises a compression member configured to compress the jacket seal.

64. The connector of claim 62, wherein a portion of the connector is configured to receive the jacket and define a third space between the jacket and the portion when the connector moves from the first position to the second position, and wherein the jacket seal is configured to be at least partially positioned within the third space.

* * * * *